US005474413A

United States Patent [19]

Georg

[11] Patent Number: 5,474,413

[45] Date of Patent: Dec. 12, 1995

[54] VEHICLE FOR COLLECTING AND TRANSPORTING WASTE MATERIALS

[76] Inventor: Edgar Georg, Auf der Seelhardt 10, D-57638 Neitersen, Germany

[21] Appl. No.: 133,045

[22] PCT Filed: Feb. 8, 1993

[86] PCT No.: PCT/EP93/00293

§ 371 Date: Oct. 12, 1993

§ 102(e) Date: Jan. 27, 1994

[87] PCT Pub. No.: WO93/15981

PCT Pub. Date: Aug. 19, 1993

[30] Foreign Application Priority Data

Feb. 12, 1992 [DE] Germany ..... 42 04 062.0
Jul. 14, 1992 [DE] Germany ..... 9209433 U

[51] Int. Cl.[6] ..... B65F 3/04

[52] U.S. Cl. ..... 414/408; 414/498; 414/517

[58] Field of Search ..... 414/406–408, 414/517, 513, 491, 492, 525.2, 498

[56] References Cited

U.S. PATENT DOCUMENTS

| | | | |
|---|---|---|---|
| 1,789,050 | 1/1931 | Ochsner | 414/407 X |
| 2,984,370 | 5/1961 | Wade | 414/492 |
| 3,140,787 | 7/1964 | Clar | 414/408 |
| 3,140,788 | 7/1964 | Clar | 414/408 |
| 3,167,195 | 1/1965 | Jensen et al. | 414/408 |
| 3,325,024 | 6/1967 | Shubin | 414/406 |
| 3,643,824 | 2/1972 | Partridge | 414/492 |
| 3,762,586 | 10/1973 | Updike, Jr. | 414/408 |
| 3,765,554 | 10/1973 | Morrison | 414/408 |
| 3,905,497 | 9/1975 | Stedman et al. | 414/408 |
| 4,096,959 | 6/1978 | Schaffler | 414/408 |
| 4,128,182 | 12/1978 | Pickrell | 414/406 |
| 4,699,557 | 10/1987 | Barnes | 414/408 |
| 4,715,767 | 12/1987 | Edelhoff et al. | 414/407 X |
| 5,044,861 | 9/1991 | Kirchhoff et al. | 414/491 X |
| 5,203,669 | 4/1993 | Klossek et al. | 414/517 X |
| 5,316,430 | 5/1994 | Horning et al. | 414/517 X |

FOREIGN PATENT DOCUMENTS

| | | | |
|---|---|---|---|
| 430550 | 6/1969 | Australia | 414/517 |
| 0405345 | 1/1991 | European Pat. Off. . | |
| 496302 | 7/1992 | European Pat. Off. | 414/408 |
| 2524857 | 12/1976 | Germany . | |
| 1101386 | 7/1984 | U.S.S.R. | 414/408 |
| 9100231 | 1/1991 | WIPO | 414/408 |

*Primary Examiner*—David A. Bucci
*Attorney, Agent, or Firm*—Spencer, Frank & Schneider

[57] ABSTRACT

A vehicle for picking up and transporting refuse includes a vehicle chassis; a driver's cab connected to the chassis; a movable collecting container positioned behind the driver's cab and having a fill opening at an end thereof disposed near the driver's cab; and a support connected to the vehicle chassis behind the driver's cab and being separate from the movable collecting container. The vehicle further includes a dumping mechanism for picking up at least one refuse container in front of a front end of the vehicle and moving the refuse container over the driver's cab for emptying the refuse container in the fill opening behind the driver's cab thereby defining a pickup position, a dumping trajectory, and an emptying position of the refuse container. The dumping mechanism includes a pivot bearing for a pair of pivot arms; a pair of pivot arms having first ends and second ends and pivotally connected to the pivot bearing at the first ends thereof; and a pick up and dumping device connected to the pivot arms. The pivot bearing for the pair of pivot arms is fastened to the support in an upper front region of the driver's cab.

40 Claims, 17 Drawing Sheets

VEHICLE FOR COLLECTING AND TRANSPORTING WASTE MATERIALS

BACKGROUND OF THE INVENTION

The invention relates to a vehicle for picking up and transporting refuse materials, the vehicle including a collecting container disposed on the vehicle behind the driver's cab. At its end toward the driver's cab, the collecting container is provided with a fill opening and with a pair of pivot arms that are provided with a pickup and dumping device for picking up at least one refuse container placed in front of the forward end of the vehicle so as to move the picked up refuse container over the top of the driver's cab and empty it in the region of the fill opening of the collecting container behind the driver's cab.

Vehicles of this type, so-called overhead loaders, are known, for example, from DE-AS [Published German Patent Application] 1,182,592, DE-AS 1,142,311 or DE-AS 1,226,053. Another variation is disclosed in US Pat. No. 4,096,959 in which, instead of a pair of arms, only one pivot arm is provided that is arranged at the side of the vehicle and is provided with a transverse beam extending transversely to the axial direction of the vehicle for picking up the refuse containers. The pair of pivot arms or the individual pivot arm, respectively, are either articulated to the vehicle frame behind the driver's cab and are given an arcuate or U-shape (DE-AS 1,182,592, DE-AS 1,142,311) or the pair of pivot arms is made of three parts and also articulated behind the driver's cab at the upper edge of the collecting container (DE-AS 1,226,053). The advantage of a so-called overhead loader is that the refuse containers can be picked up in the front region and thus in the viewing range of the driver. The prior art vehicles of this type, however, have the serious drawback that a considerable amount of clearance is required above the vehicle for pivoting and emptying the picked up refuse container, such space often not being available in cities, be it because of overhead streetcar conduits, telephone lines or also low tree branches which impede the pivoting process.

SUMMARY OF THE INVENTION

It is the object of the invention to configure a vehicle of the above-identified type in such a way that it can be emptied cleanly and the permissible clearance profile given by the collecting container disposed on the vehicle is exceeded only slightly even during pivoting and emptying of a picked up refuse collecting container.

This is accomplished according to the invention in that a beam is provided at the vehicle which is separate from the collecting container and is in communication with the vehicle chassis and to which is fastened the pair of pivot arms and its pivot bearing in the upper frontal region of the driver's cab. By arranging the pivot bearing of the pair of pivot arms in the upper frontal region of the driver's cab, particularly if a lower situated driver's cab is involved, much shorter pivot arms result compared to the prior art systems, which inevitably leads to a reduction in the clearance required for the pivoting process in the region above the driver's cab. However, the doors of the driver's cab remain freely accessible so that unimpeded access is possible at any time. Due to the provision of a separate beam, a structurally perfect connection is possible without interfering with the putting down of the collecting container.

A particularly advantageous feature of the invention provides that the device for picking up and dumping the refuse container, which is connected with the pair of pivot arms so as to be pivotal about a horizontal axis, is connected by means of at least one drive means with the pair of pivot arms which hold the refuse container connected with the pickup and dumping device in an approximately vertical orientation during the pivoting travel over the top of the driver's cab and controllable means are provided to tip the picked up refuse container.

In this way it is ensured that nothing can fall or flow out of the refuse container during the pivoting process so that the dumping of the picked up refuse container occurs only directly above the fill opening of the collecting container. As a result, not only is the height reduced from which the refuse drops but also a positive emptying process is ensured that does not contaminate the environment. The drive means may here be a mechanical structure in which a transmission rod assembly is able to synchronously transfer the pivoting movement of the pivoting device as generated by the pivoting drive of the pivoting device to the pickup and dumping device by mechanical means. The mechanical coupling is here effected in such a manner that the pivoting movement of the pickup and dumping device is in synchronism with the pivoting speed but takes place in the opposite direction as the pivoting direction. With geometrically more complicated pivoting devices, particularly with U-shaped or angled pivot arm pairs, such a mechanical coupling is relatively complicated and leads to an increase in weight so that then preferably a hydraulic drive means should be provided which acts directly on the pickup and dumping device in which the control takes place as a function of the pivot angle of the pivoting device by way of an appropriately controlled intake and discharge of the hydraulic fluid.

A feature of the invention therefore provides that the drive means is constituted of at least one oil motor which is connected with the pickup and dumping device. By appropriately regulating the intake and discharge of hydraulic fluid, the desired relative movement between pickup and dumping device, on the one hand, and the pivoting device, on the other hand, can thus be realized to maintain the vertical orientation of the refuse container.

Another feature of the invention provides that the drive means is constituted of at least one hydraulic cylinder that is connected with the pivoting device and is preferably connected with the pickup and dumping device by means of a transmission rod assembly. Hydraulic cylinders are of a simpler construction and here have the advantage that they can be fastened to move in parallel with the respective components of the pivoting device, for example the pivot arms. Particularly if the pivoting device must traverse pivot angles of 100 degrees and more from the pickup position to the emptying position, such a hydraulic cylinder can no longer be connected directly with the pickup and dumping device, but a transmission rod assembly must be provided which permits a translation of the linear piston movement into a pivoting movement over more than 100 degrees.

Compared to mechanical drive means, the use of hydraulic drive means has the advantage that it is independent of the geometrical configuration of the pivoting device or the pairs of pivot arms since the supply of energy to the drive means can be effected through pipe conduits and/or hoses which can easily be installed to follow the outlines of the pivoting device. If a pair of pivot arms is employed, an oil motor or a hydraulic cylinder is advisably arranged on each pivot arm. If hydraulic cylinders are employed, these are advisably configured as dual-action cylinders so that an appropriate control of the intake and discharge of hydraulic fluid is able to produce the required synchronism, that is movement of pivoting device and pickup and dumping device at the same pivoting speed but in opposite directions of rotation can be realized.

In this connection, a feature of the invention provides that the drive means for establishing synchronism with the pivoting movement of the pivoting device is connected with a pump assembly that can be driven by the pivoting movement of the pivoting device. This pump assembly here serves merely to drive the hydraulic drive means of the pickup and dumping device and is itself driven by the pivoting drive of the pivoting device. The desired control of the pickup and dumping device in dependence on the pivot angle of the pivoting device is here accomplished in a simple manner. If an oil motor is employed, an appropriate assembly operating as a pump is provided. If hydraulic cylinders are employed, one or a plurality of hydraulic piston-cylinder units should be arranged at the vehicle to operate the pivoting device.

Another advantageous feature of the invention provides that the drive means simultaneously constitutes the tipping drive, with reversing means being provided which, after the refuse container reaches the emptying position, switch from the pump assembly for synchronism control to a pressure oil supply and pivot the pickup and dumping device into the dumping position and back again into the vertical position, whereupon the system is switched back to synchronism control. This considerably reduces construction expenditures and advantage can be taken—for example, if hydraulic cylinders are employed—that, due to the pivoting movements in opposite directions and with the hydraulic cylinders dimensioned accordingly, the latter will be in an end position when the dumping position is reached so that practically the full cylinder stroke is available again for the dumping movement for emptying.

Another feature of the invention provides that the pair of pivot arms are in communication with means which produce a shortening of the total radius given by the pair of pivot arms and the picked up refuse container at least in the region above the driver's cab. As a feature of the invention, the means may reside in extensions that are guided in the manner of a telescope along the pairs of pivot arms and with which the pickup and dumping device is connected. In another advantageous embodiment, the means may be constituted of a pair of guide arms that are connected with the free ends of the pair of pivot arms.

Another particularly advantageous feature of the invention provides that the pair of guide arms is arranged so as to be pivoted between the free ends of the pair of pivot arms. Over the entire pivoting path the guide means hold the pair of guide arms essentially against the vehicle and keep them oriented at a constant angle relative to the horizontal. With such an arrangement it is possible, particularly in vehicles in which the driver's cab is situated lower, that the pivoting into the emptying position and particularly also the tipping of the picked up refuse container in order to empty it requires a clearance which does not exceed or only slightly exceeds the permissible height of the collecting container on the vehicle. Another advantage of this arrangement is that the guide means effecting the vertical orientation of the pickup and dumping device during the pivoting travel extending over the top of the driver's cab can be made much simpler. The arrangement of the pair of guide arms, which can be pivoted through between the free ends of the pair of pivot arms, permits this guide means to be associated with the articulating region between the free ends of the pair of pivot arms and the pair of guide arms, while the tipping drive in turn is then supported by the pair of guide arms. In this way a decoupling arrangement results which leads to a considerable structural simplification.

A particularly advantageous feature of the invention provides that the drive means for vertically guiding the refuse container is constituted of at least one first toothed wheel that is stationarily disposed at the pickup and dumping device or at the pivot bearing of the pair of pivot arms and a second toothed wheel that is fixed to the pivot point of the pickup and dumping device or to the pair of guide arms and is connected with the first toothed wheel by way of a form-locking endless traction means, particularly a chain. During pivoting of the pair of pivot arms, the chain rolls off on the stationary toothed wheel and thus pivots the pickup and dumping device and the pair of guide arms, respectively, relative to the pair of pivot arms. By selecting the transmission ratio between the first toothed wheel and the second toothed wheel it is now also possible, depending on dimensions, to produce a "leading" or "dragging" of the relative movement of the pair of guide arms with respect to the pair of pivot arms, in which case, however, the orientation of the pair of guide arms in space should essentially be maintained. With toothed wheels of identical size, this accordingly results in a constant orientation of the pair of guide arms in space during the entire pivoting process so that a picked up refuse container also remains vertically oriented up to the end of the pivoting process so that the dumping process is initiated by the tipping drive only after the refuse container is disposed above the fill opening. Advisably, appropriate toothed wheels and endless chains are disposed at each pivot arm so as to produce the greatest possible utilization of the system with respect to the weights that have to be managed.

Another advantageous feature of the invention provides that the pair of pivot arms and its pivot bearing are connected with the beam by way of a rotary bearing so as to be pivotal about a vertical axis. This arrangement has the advantage that the refuse containers to be picked up can be picked up not only from a position in front of the driver's cab but also from a position next to the track of the vehicle. Thus it is possible to place the refuse containers to be picked up in a row next to one another and to drive the vehicle along the row and pick up the individual refuse containers in succession, empty them and set them down again next to the vehicle. Another advantage of this arrangement is that such a vehicle is also able to load a second collecting container that is carried along on a trailer, which is of particular advantage if larger quantities of refuse must be collected in rural areas or special types of refuse must be collected in addition to normal refuse. For this purpose, the trailer and its collecting container for special types of refuse is then placed next to the vehicle so that the normal refuse can be emptied into the collecting container on the vehicle and the refuse containers containing the special types of refuse can be emptied into the collecting container on the trailer next to the vehicle or on a second vehicle.

Another feature of the invention provides that the rotary bearing is connected with the beam so as to be displaceable in the longitudinal direction and/or in the transverse direction relative to the vehicle. The displaceability of the pivot arms in addition to their being pivotal about a vertical axis offers the advantage that changes in spacing in the horizontal direction are performed by the entire system without having to move the vehicle itself. This is of advantage for picking up the refuse containers in the front region and in the side region of the vehicle as well as for the case when a refuse container is to be emptied into a collecting container disposed on a trailer next to the vehicle. It is then advisable for the rotary bearing to be connected with the beam so as to be displaceable in the longitudinal direction relative to the vehicle and the pivot bearing is connected with the rotary bearing so as to be displaceable transversely to its axis. Here again the individual moving elements are decoupled from one another in a manner that simplifies the structure so that here again the associated drives for producing the movement, for example hydraulically charged piston-cylinder units, can be arranged in a simple manner.

U.S. Pat. No. 4,096,959 and EP-A 0,163,859 disclose a further vehicle equipped with a pair of pivot arms for picking up refuse containers in its front region. In this vehicle, instead of a directly fillable container, a pouring chute that cooperates with a press is arranged behind the driver's cab. The discharge opening of the pouring chute can be connected with the fill opening of a collecting container that is releasably connected with the vehicle. The pivot arm arrangement according to the invention is usable with advantage particularly for vehicles in which the collecting container is releasable. However, to be able to accomplish this, the desired "clean" operation requires additional measures in this area. As a further feature of the invention which, however, is not limited to the arrangement of the pair of pivot arms according to the invention including the pickup and dumping device, it is provided that the discharge opening is given a tubular extension which passes through the fill opening disposed in the lower region of the end wall of the collecting container and extends into the collecting container. Sealing means are provided to seal the tubular extension against the fill opening. This arrangement makes possible a perfect seal between the press and the releasable collecting container since the gap between the tubular extension and the fill opening is sealed and no refuse is able to escape from the collecting container. Advisably, all side faces of the tubular extension are covered by sealing elements so that the sealing means also extends over the entire periphery. The sealing means may then also be configured as a spring tensioned flap which acts at least on the top face of the tubular extension.

By arranging a channel-like protective covering in the interior of the collecting container, particularly if the latter is provided with a check plate in the form of a closure for the fill opening that is preferably pivotal into the opening cross section, and which is preferably articulated by means activated from the outside of the connecting container, proper release of the collecting container from the vehicle can be realized without any material being able to fall out of the container. The collecting container is here pulled a short distance away from the press but only to the extent that the free end of the tubular extension is still disposed in the fill opening. Then the check plate is pivoted in. This may be effected from the top, from the bottom or by means of two partial check plates that extend in the manner of door wings from the side walls of the protective covering. If the pivoting in the closing direction occurs in synchronism with the filling stroke of the press, the latter can be used for actuation so that only the appropriate closing means for the check plate need be provided at the collecting container, and these should be actuatable from the exterior. The check plate may also be constructed to be releasably connected with the frontal face of the pressure ram, on the one hand, and with the channel-like protective covering, on the other hand. During the filling process, the check plate remains connected with the pressure ram. When filling is completed, the check plate is moved into the channel-like protective covering, is locked there and is simultaneously released from the pressure ram and the latter is retracted again. The shutoff door may then also be closed.

With the appropriate configuration and if the check plate is pivotal or insertable, the check plate may eliminate the requirement for an additional door in front of the fill opening.

Another feature of the invention provides that the tubular extension of the discharge opening of the pouring chute has an associated operating device which is provided with a drive and with carrier means that can be connected with a corresponding detent on a fill opening shutoff door that is vertically guided at the collecting container. This arrangement makes it possible to transport the collecting container completely closed when it is empty or filled. The empty collecting container is here pushed onto the vehicle from the rear or the vehicle drives underneath the collecting container which is stood up on legs. The carrier of the operating device then goes into action so that the shutoff door of the fill opening is opened and the tubular extension of the discharge opening can be introduced. The filled collecting container is released from the vehicle in the reverse sequence. For this purpose, the collecting container is pushed to the rear to such an extent that the extension of the discharge opening is pulled completely out of the fill opening so that then the shutoff door can be closed by way of the operating device. The particular advantage of this arrangement is that no drive devices are required at the collecting container itself, instead the driving devices are connected with the vehicle and can be driven by way of the energy supply for the vehicle. The drive may here be formed, for example, by a piston-cylinder unit that is connected with the carrier or also by an endless chain that is connected with the carrier and is driven by way of a hydraulic motor. Advisably appropriate drivable actuating elements are provided at the operating carrier by means of which it is possible to act on the actuating and/or closing means of the check plate at the channel-like protective covering in the collecting container. With the appropriate coupling of the controls, it is thus possible to obtain fully automatic operation in which the function sequences are chained to one another.

Another feature of the invention provides that a moving device is disposed at the vehicle. This moving device is connected with a drive and serves to move the collecting container at least over part of its path when it is picked up and put down. This moving device may, for example, be constituted of a portal-like angle arm equipped with hooks, a so-called hook lift, that is arranged on the vehicle so as to be pivotable and displaceable in the longitudinal direction in order to grip around the fill opening. The particular advantage of the hook lift is here that the collecting container, if appropriately locked at its rear end, can be emptied also by dumping. The pickup process is here configured in such a way that for pickup the last portion and for put-down the first portion of the movement path is performed by a displacement in the longitudinal direction of the vehicle so that proper insertion and release, respectively, of the tubular extension of the pouring chute is ensured. However, the movement device may also be constituted of a carriage that is longitudinally displaceable on the vehicle and is equipped with vertically oriented lugs that are able to engage in corresponding recesses at the collecting container so that the collecting container can be placed onto the vehicle by means of lifting devices or the like and then moved into its final position while introducing the tubular extension. This system is particularly suitable also for those cases where the collecting containers to be picked up and put down have legs so that the vehicle is able to drive underneath them, with appropriate devices belonging to the vehicle for changing the height of the vehicle enabling them to be picked up or put down. It is particularly advisable for the operating device to be disposed on the moving device.

A preferred feature of the invention further provides that the beam for the pair of pivot arms is fastened to the vehicle chassis behind the driver's cab. This arrangement has the advantage that the required rigid connection between the vehicle chassis and the beam is not interfered with by other installed units, particularly not by the engine suspension. This embodiment, however, makes it possible, on the other hand, to extend the beam to beyond the driver's cab so that neither the peripheral view from the driver's cab nor the free access to the driver's cab is interfered with by the pivot arms and the support.

Another advantageous feature of the invention provides that the beam is fastened to the vehicle chassis by means of a three-point suspension. With respect to the longitudinal axis of the vehicle, two adjacent fastening points are fixed to the vehicle chassis and the third fastening point is articulated to the vehicle chassis at a distance therefrom. This arrangement has the advantage that the beam which is rigid per se and is to be fixed to the vehicle chassis does nevertheless not interfere with the torsion of the vehicle chassis about the longitudinal axis. In this connection it is particularly advisable for the articulation of the third fastening point to be disposed in the region of the longitudinal center axis of the vehicle chassis so that this articulation point performs practically no transverse movements when the vehicle chassis experiences torsion. In this connection it is particularly advisable for the two rigid fastening points to be disposed in the region adjacent to the driver's cab, while the third fastening point is spaced therefrom in the direction toward the rear of the vehicle. Another advantage of this three-point support is that it also reliably absorbs the tipping moment that is introduced during operation by way of the refuse containers being manipulated.

Another advantageous feature of the invention provides that locking means for firmly coupling the collecting container are disposed at the beam. With such locking means which may be formed, for example, of lugs and/or hooks disposed at the beam so as to engage in corresponding recesses in the front region of the collecting container, it is accomplished that the beam, on the one hand, and the collecting container, on the other hand, form an essentially rigid unit so that practically no relative movement, in any case no interfering relative movement, can occur between the collecting container and the tubular extension of the pouring chute that projects into it through the fill opening. The locking means are advisably provided with actuating means, for example in the form of hydraulic cylinders or the like. Moreover, the weight of the coupled-on collecting container absorbs part of the tipping moment in the region of the articulated fastening point which leads to stress relief of the vehicle chassis in this region.

Another advantageous feature of the invention provides that the drive means for the press of the pouring chute are also mounted on the beam and the pressure ram is guided there. Since the beam must in any case be constructed as a practically rigid structural unit, this measure results in a guidance of the pressure ram without canting.

A particularly advantages feature of the invention provides that the beam is configured as a box-like structure, with the pouring chute and the side walls being part of the supporting structure of the beam. This arrangement has the advantage that a rigid structure is formed which is able to absorb the load during operation of the pair of pivot arms as well as the load during actuation of the press while saving weight.

Another feature of the invention provides that at its top the pouring chute ends in side walls which extend essentially beyond the driver's cab into the front region. This arrangement has the advantage that, when the refuse container is pivoted upward, it is laterally shielded even before its emptying point so that, if the contents are dusty, the escape of dust due to wind is reduced to a minimum.

Another feature of the invention provides that a guide for a displaceable covering is provided at the top edge of the two side walls. Since the configuration of the pair of pivot arms according to the invention makes it possible to pivot back the arms without refuse containers to far beyond the pouring chute so that their free ends lie below the upper edge of the collecting container, the arrangement of a covering makes it possible, when merely driving, for example, into the area of use or to pickup and put-down locations for the releasable collecting container, to cover the entire arrangement and thus shield it against the influences of weather. In this connection it is advisable for the rear ends of the guides to form a covering that can be pivoted upward. This increases the clearance space above the pouring chute for the emptying process and at the same time the pouring chute is still partially shielded without the clearance space for the emptying movement being interfered with. During collection operations in heavy rain as well, at least the region above the pouring chute can be shielded temporarily by the covering so that the influx of rain water into the collecting container is reduced to a minimum.

Another advantageous feature of the invention provides that a transverse beam for supporting, guiding and locking the collecting container is disposed in the region of the rear end of the vehicle chassis. This transverse beam is mounted so as to be pivotal about a pivot axis that extends in the longitudinal direction of the vehicle. Preferably the pivot axis is flush with the joint axis of the third fastening point of the beam. This embodiment has the advantage that, during the driving mode, the vehicle chassis is able to twist about its longitudinal axis in the intended manner in spite of the practically rigid coupling of the inherently rigid collecting container to the likewise inherently rigid beam without causing any secondary bending between the collecting container and the vehicle chassis. Thus the collecting container is also connected with the vehicle chassis in a three-point support, with the two forward support points being constituted of the fixed support points of the beam at the vehicle chassis, while the third support point is constituted of the pivot bearing of the transverse beam. The joint supporting the transverse beam may here also be a ball joint.

Another advisable feature of the invention provides that at least one positioning spring element is provided which acts between the transverse beam and the vehicle chassis. In this way it is ensured that in the no-load state the transverse beam, which is provided with guide rollers and/or locking elements for the collecting container, is oriented horizontally with respect to the vehicle chassis so that it is able to precisely engage in the guide rollers when picking up or driving underneath the collecting container.

BRIEF DESCRIPTION OF THE DRAWINGS

The configuration of a vehicle equipped according to the invention will now be described in greater detail with reference to schematic drawings, in which.

DETAILED DESCRIPTION OF THE INVENTION

Figure 1:
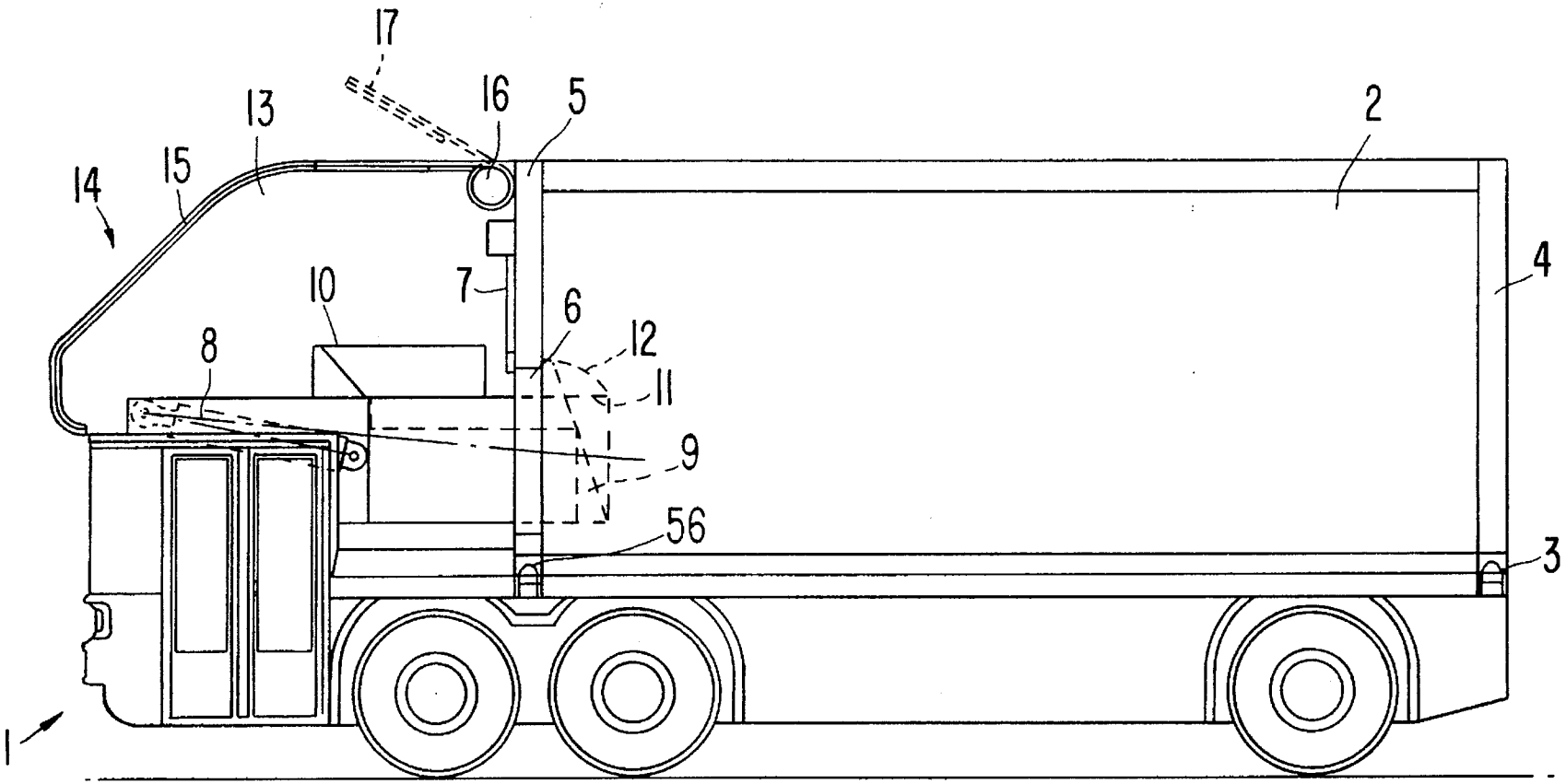
FIG. 1 is a side view of the vehicle without the pair of pivot arms.
Figure 12:
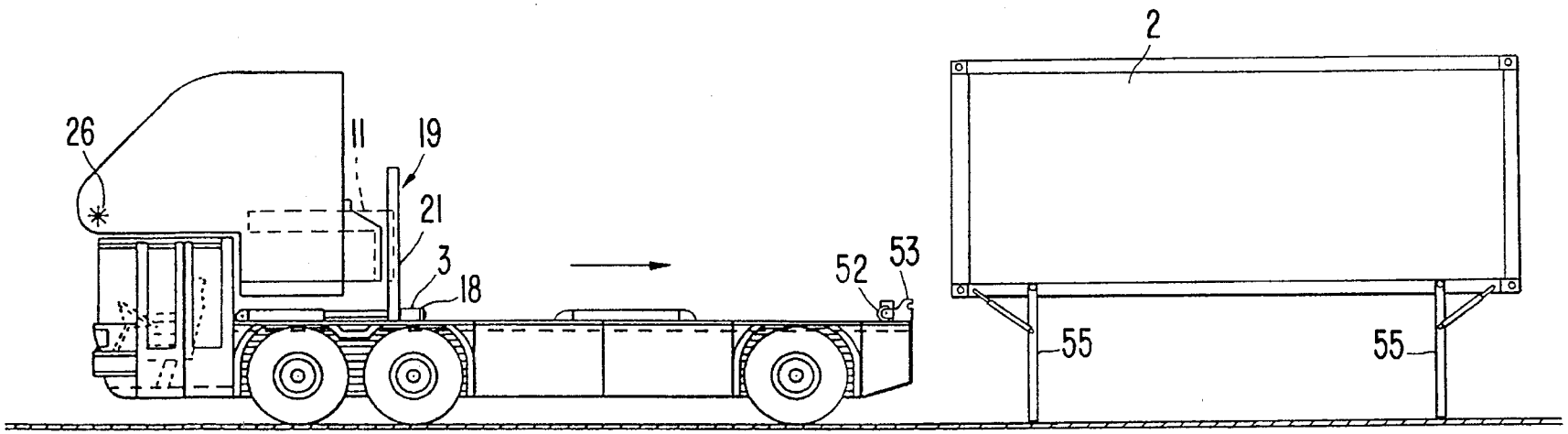
FIGS. 12–15 depict the motion sequence during the changing of collecting containers.

The vehicle for picking up and transporting refuse materials shown in FIG. 1 is provided with a lower situated driver's cab 1 so that a larger clearance is available above the driver's cab. In addition, a collecting container 2 is releasably disposed on the vehicle; it is fastened by way of lugs or closures 3. After release of closures, the collecting container 2 may be separated from the vehicle in different ways. This may be accomplished either in that collecting container 2 is provided with downwardly extendable supports, which are shown in detail in FIG. 12, so that the vehicle, which is equipped with a lowering device, is able to move away, after being let down, from the stood-up collecting container. The picking up then occurs in the reverse order as will be described in connection with FIGS. 12 to 15.

However, it is also possible to additionally provide the vehicle with a so-called hook lift with which a picked up collecting container is initially moved horizontally backward for a short distance and is then pushed further back by pivoting the lifting hook so that the vehicle is able to move forward with the lifting hook continuing to pivot as soon as the rear edge of the collecting container touches the ground and is thus able to put the collecting container down on the ground. The picking up of an empty collecting container is effected in the same manner. Such hook lift constructions are known and their configuration need not be described in detail here. However, the arm carrying the hook must have a U-shape so that it grips around the discharge opening of the pouring chute.

Another possibility is to provide the vehicle with a so-called dumping platform which is equipped with a cable winch so that, after release of the lock and renewed displacement of the collecting container horizontally backward, the dumping platform can be pivoted upward while the collecting container is lowered with the aid of the cable winch over the sloping dumping platform until the rear edge of the collecting container touches the ground again and the vehicle is able to move forward while further lowering the collecting container until it finally rests on the ground. The picking up again occurs in the reverse manner.

The arrangement of a dumping platform, if instead of a cable winch a hydraulic lifting device is provided, permits the collecting container to be placed vertically on its rear end face instead of setting it down on its bottom face. For this purpose it is merely necessary, during pivoting up and simultaneously lowering the collecting container, to pivot the dumping platform into the 90° position as soon as the lower rear edge of the collecting container is standing on the ground. At the same time, the vehicle then moves backward correspondingly. Picking up occurs in the reverse sequence.

The rear wall 4 of collecting container 2 is configured in the conventional manner as a lockable flap so that, after opening of the lock, the contents of the collecting container can be emptied by tipping the container downward. The collecting container may also be configured in such a way that the front wall 5 is configured as an emptying flap and can be folded upward in its entirety for emptying.

In the lower region of the front wall 5 a fill opening 6 is provided which can be locked by way of a door 7, for example a vertically displaceable and arrestable sliding door, attached to its exterior.

On the vehicle itself, in the space between the driver's cab 1 and the end wall 5 of collecting container 2, a press is disposed which includes a hydraulic pressing cylinder 8 and a pressure ram 9 which here is shown in dashed lines in the pressing position. The press further includes a pouring chute 10 whose discharge opening is constituted of a tubular extension 11 which has such dimensions that it projects into collecting container 2 through its fill opening 6. If now, with pressure ram 9 retracted, refuse is thrown into pouring chute 10, pressure ram 9 is able to push the refuse into collecting container 2 through the tubular extension 11 of the discharge opening of pouring chute 10. As will be described below, the tubular extension has an associated channel-like protective covering 66 that extends in the collecting container around the edge of the fill opening and into which extension 11 is inserted. This permits not only the arrangement of seals to seal the gap between extension 11 and protective covering 66 over at least part of the periphery but also the arrangement of an additional check plate in the interior of the collecting container in order to prevent the escape of partial quantities of the contents of the container when collecting container 2 is released.

A pivotal flap 12 may also be disposed above fill opening 6 on the interior of the end wall 5 of collecting container 2 so as to extend over the width of the fill opening. This flap has such dimensions that, with extension 11 inserted, it rests on the latter. If now collecting container 2 is retracted, flap 12 pivots downward and covers the upper region of fill opening 6 to secure it against the container contents falling out before door 7 is closed.

Pouring chute 10 ends toward the top in the form of side walls 13 which extend essentially beyond the driver's cab 1 into the front region. In order to simplify the illustration, the front side wall is not shown in FIG. 1. The upper edges 14 of both side walls are provided with a guide for a displaceable and preferably rollable covering 15 so that the space above the driver's cab and the press can be completely closed during the driving mode. By way of a displacement drive 16, for example a winding device, this space can then be opened by retraction of covering 15. The end 17 of guides 14 adjacent to winding device 16 is here advisably configured in such a way that, with the covering retracted as shown in dashed lines, it can be pivoted upward. Thus, on the one hand, the free space required for the pivoting and pouring process is enlarged, as will be described in greater detail below, and, on the other hand, however, the opening of the pouring chute 10 is covered to a certain degree so that, for example in rainy weather, the entrance of rain into the pouring chute is substantially prevented. If covering 15 is retracted completely, an additional metal covering sheet must be provided as a shield.

Figure 2:
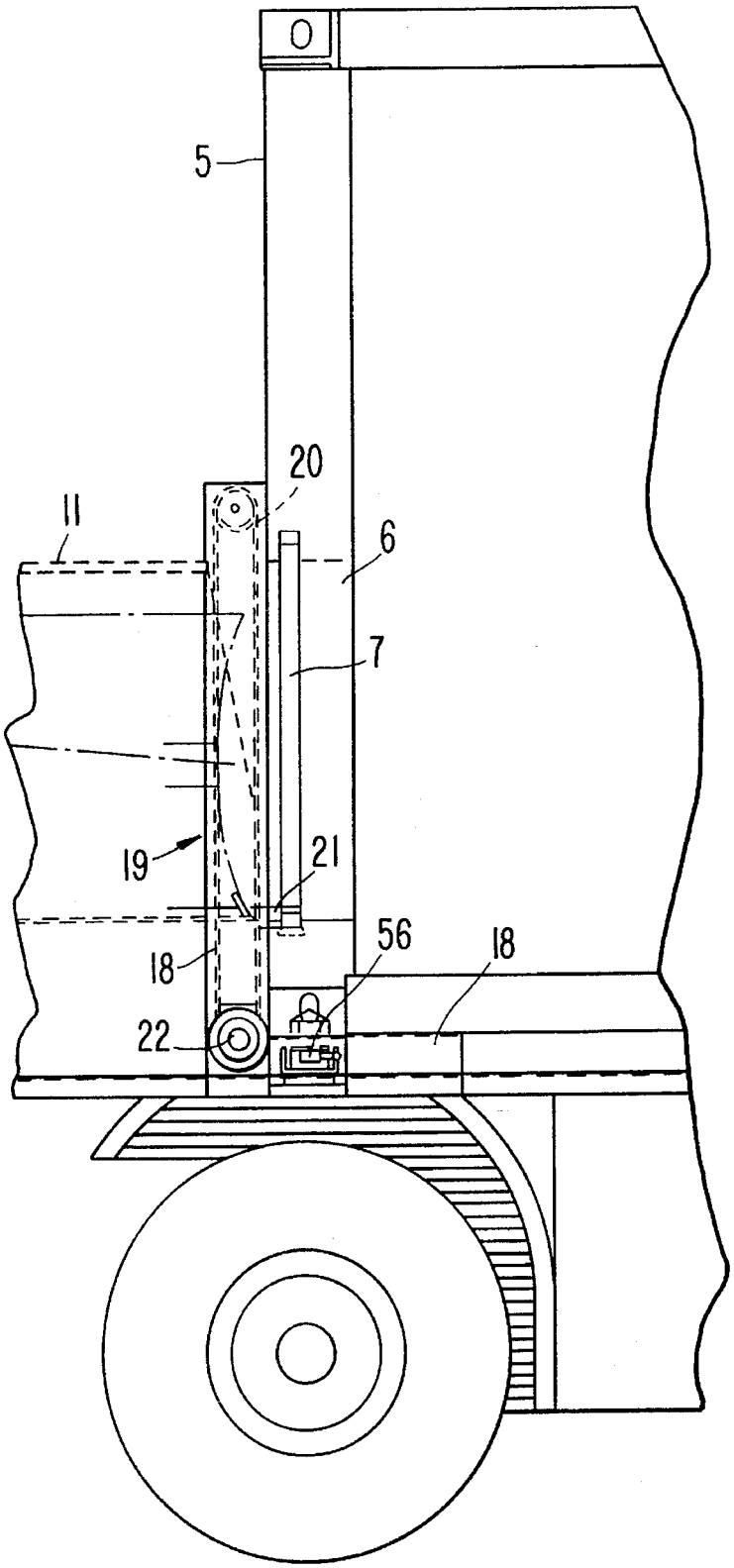
FIG. 2 depicts, to a larger scale, the configuration of the lock for the fill opening at the collecting container.

For the exchange of collecting containers 2, the vehicle described in connection with FIG. 1 is now configured in such a manner that collecting container 2 is provided with supports that are extendable toward the bottom and are not shown in detail here, with the vehicle itself being lowerable by a slight amount in order to release the container after closures 3 have been opened and thus is able to drive out from under the container. In order to facilitate the introduction of the tubular extension 11 into the fill opening 7 of the collecting container in a vehicle of such a configuration, the vehicle is provided with a carriage 18 that is equipped with a hydraulic cylinder for its drive. As shown in FIG. 2, this hydraulic cylinder is mounted so as to be displaceable on the vehicle over a displacement path of about 50 to 100 cm. Carriage 18 supports the front closure 3 in the form of a carrier. If now carriage 18 is in its rearward position, the lowered vehicle is able to move underneath the collecting container 2, in order to pick up a stood-up collecting container 2, until the forward closure element at collecting container 2 lies approximately above closure 3 of carriage 18. Then the vehicle is raised so that closure 3 engages in the closure element at collecting container 2 and closure 3 is closed. Now carriage 18 is pushed forward so that, with door 7 open, the tubular extension 11 is able to move into fill opening 6. The steps of this process are shown in FIGS. 12 to 15.

To make the opening of door 7 automatic, an operating device 19 is provided at the vehicle, for example in the form of an endless chain or a toothed belt 20 which is equipped with a carrier 21. Chain 20 can be driven by way of a drive 22, for example a hydraulic motor. The door 7 of fill opening 6, configured as a sliding door, now is provided with an appropriate detent into which carrier 21 is able to engage so that, when advanced by way of carriage 18, carrier 21 initially engages in the detent of door 7 and operating device 19 is able to open the door by displacing it upward. Then carriage 18 continues to move forward until extension 11 is introduced through fill opening 6 and the rear end of the container can likewise be locked by means of the associated closure 3.

It may also be advisable in this system for operating device 19 and carriage 18 to constitute a structural unit so that, if a collecting container is picked up in the manner described above, the detent of door 7 already engages in carrier 21 when the closure 3 connected with carriage 18 is locked. Door 7 can then be opened even before the carriage moves collecting container 2 in the direction toward the tubular extension 11 of the press. Appropriately controllable and drivable actuating elements for the actuation and closing means of a check plate disposed within the collection container may also be arranged at the operating device.

In an embodiment including a hook lift, the structural component for horizontal displacement until the final lock is established customary in such a system replaced the above described carriage 18. The lifting hook is given the corresponding frame shape so that, in the operational state, it grips around the exterior of the tubular extension 11 of press 7. In this system, the operating device may be integrated in the angled portion of the lifting hook, that is, the portion that is oriented toward the top in the operational state.

Figure 3:
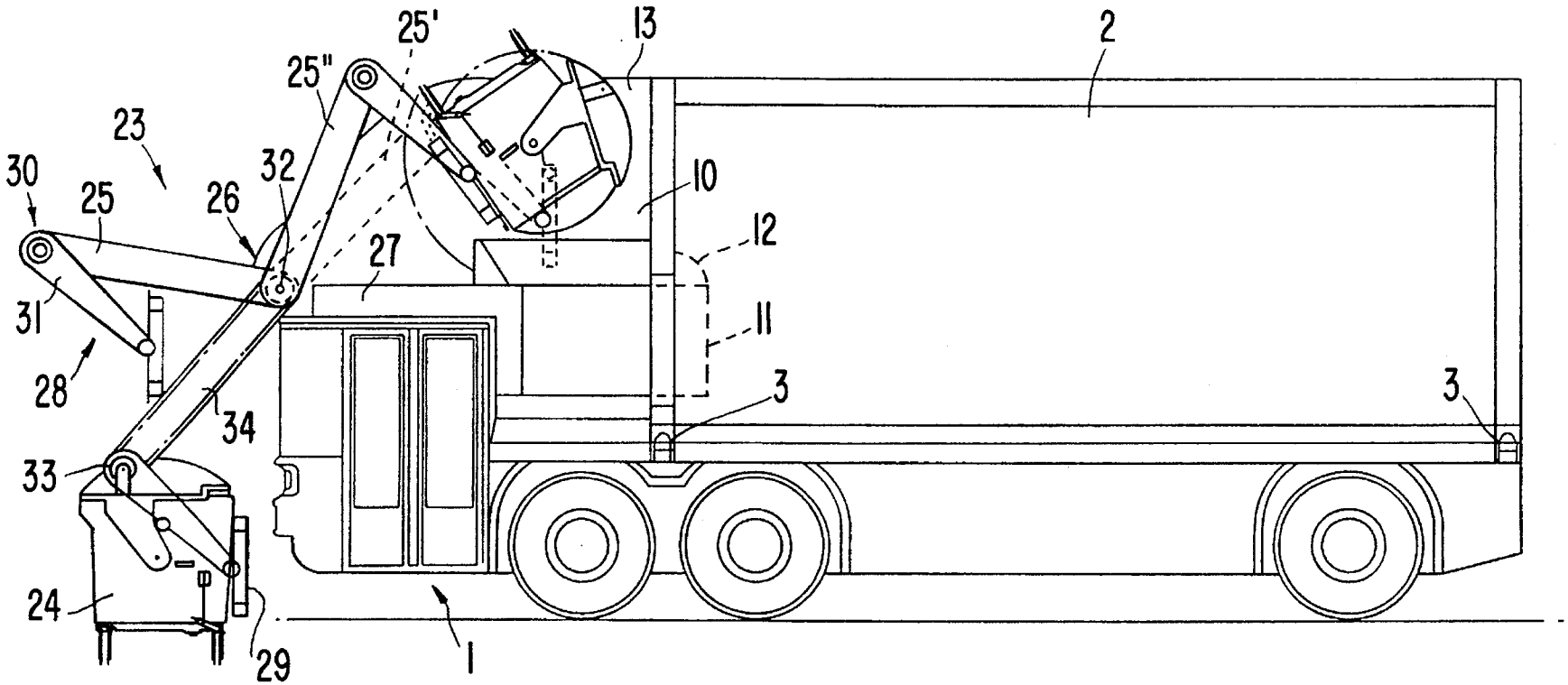
FIG. 3 depicts the structure and operation of one embodiment of the pair of pivot arms.
Figure 19:
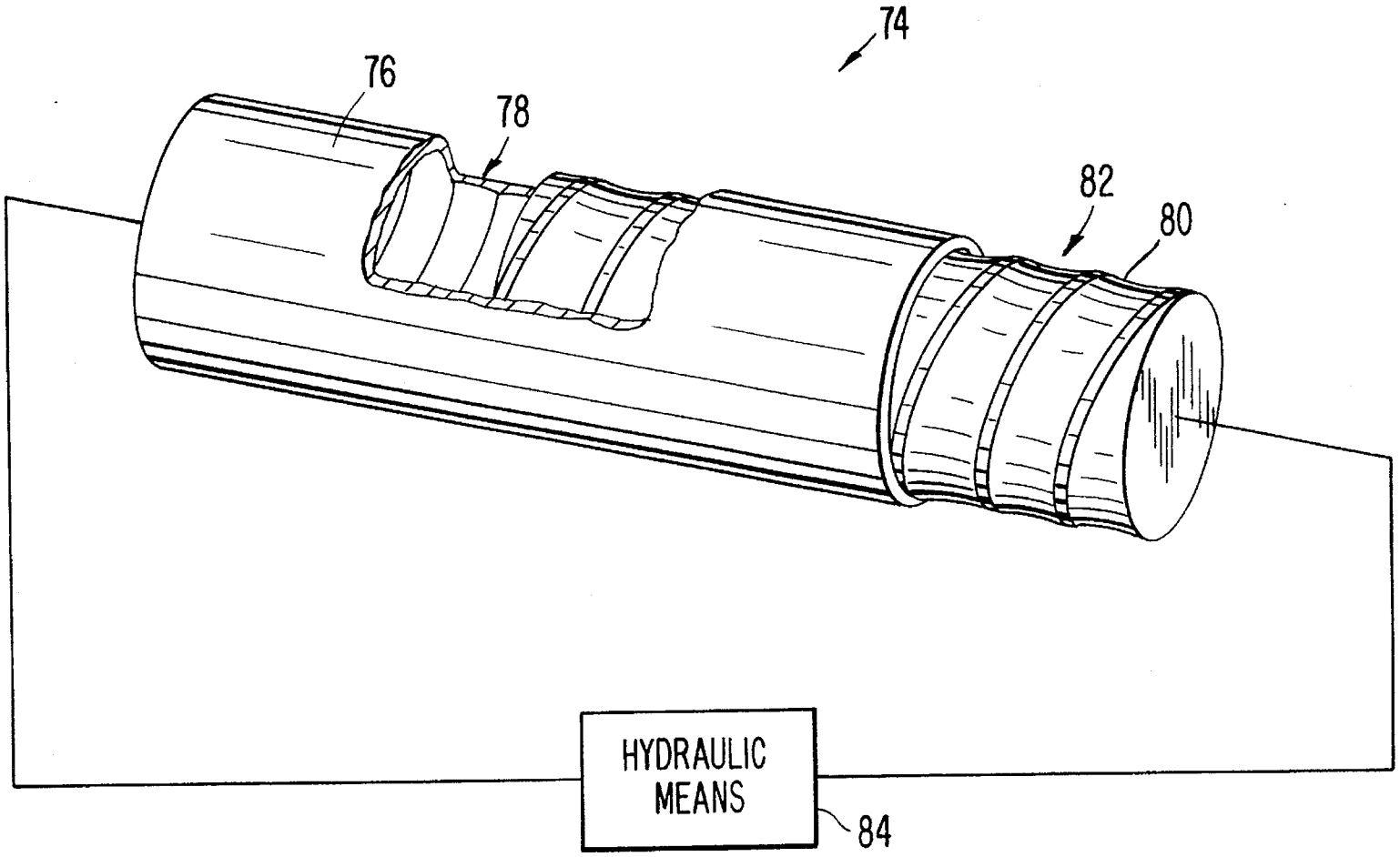
FIG. 19 depicts a portion of a hydraulic pivoting motor for use in connection with the pivot arms of the present invention.

In conjunction with the above-described vehicle, FIG. 3 now depicts and describes a device 23 for picking up and emptying a refuse container 24. All elements described in detail above and not necessary for an explanation of the operation of device 23 have been omitted from FIG. 3 for reasons of simplifying the illustration. Device 23 is constituted of a pair of pivot arms 25 whose pivot arms are arranged parallel to one another and at a distance from one another that approximately corresponds to the width of driver's cab 1. The pair of pivot arms 25 is provided with a pivot bearing 26 that is arranged at a beam or support 27 disposed in the front region above driver's cab 1. The pair of pivot arms 25 is provided with a pivoting drive of such configuration that the pivot arm can be pivoted along a dumping trajectory over an angle of approximately 180° from the illustrated, lower pickup position into the upper rest position, or emptying position 25' shown in dashed lines. The pivoting drive may be constituted, for example, of one or a plurality of hydraulic piston-cylinder units, with the required pivot angle being realized by means of appropriate lever arrangements. This will be shown in greater detail in FIGS. 4 to 6. Advisably, the configuration of the pivoting drive is also provided in the form of a so-called hydraulic pivoting motor 74, a portion of which is shown schematically in FIG. 19. Here, two shaft-piston elements, including a shaft 76 and a piston 80, are nested in one another in the manner of a telescope. Shaft 76 and piston 80 are provided with a broad helical arrangement of teeth to be axially displaceable by hydraulic means 84 shown in schematic form. The axial movement is converted into a rotary movement by corresponding interior teeth that are fixed to the housing and cooperate with the teeth of the shaft. Note that FIG. 19 shows a section of shaft 76 having been cut open to reveal helical interior teeth 78 disposed therein. FIG. 19 further shows a section of piston 80 nested within shaft 76, and showing teeth 82 disposed thereon.

In the embodiment according to FIG. 3, the pair of pivot arms 25 is now connected with a guide means 28 that carries a pickup and dumping device 29 for the refuse container 24. The guide means 28 is here configured in such a way that, during the pivoting of refuse container 24 over a path extending over the top of driver's cab 1, the container remains approximately in a vertical orientation until the pair of pivot arms has been pivoted into the emptying position 25" which is still shown in solid lines. In this position, the pickup and dumping device, which carries the refuse container 24, is pivoted by way of its own tipping drive, not shown in greater detail here, for example a hydraulic piston-cylinder arrangement mounted at the guide means, into the illustrated emptying position so that the contents of the container are able to drop into the pouring chute 10 of press 7.

The illustration of device 23 in three different positions of its pivot path shows that, already during pickup and over its entire pivoting path, the refuse container 24 and its guide means are pivoted through between the pair of pivot arms so that the free space required is practically limited by the free end 30 of the two pivot arms; that is, at no time does the pair of pivot arms or the container noticeably exceed this region. The illustration in FIG. 3 also shows that the free space required by device 23 during operation only slightly exceeds the height given by the upper edge of collecting container 2 so that a clearance profile of less than 4.3 m can be maintained.

In the illustrated embodiment, the guide means 28 is constituted of a pair of guide arms 31, with each guide arm being articulated to the respective free end 36 of a pivot arm 25. The pickup and dumping device 29 is then mounted with its tipping drive to the free end of the pair of guide arms 31. The pair of guide arms 31 are here connected with the pair of pivot arms 25 in such a manner that, during the entire pivoting travel, they essentially remain oriented, with respect to the vehicle, at an essentially constant angle relative to the horizontal as this is evident from the drawing. For this purpose, a drive is provided which is essentially composed of a stationary toothed wheel 32 in the pivot plane of the pair of pivot arms 25 at pivot bearing 26 and a corresponding toothed wheel 33 which is fixed to a guide arm. In each case, both toothed wheels are connected with one another by way of an endless chain 34 so that, when the pair of pivot arms 25 are pivoted upward, chain 34 "rolls off" on stationary toothed wheel 32. Since both toothed wheels have the same diameter, this causes toothed wheel 33 and thus the associated guide arm to be held in the same orientation relative to the vehicle as the stationary toothed wheel 32. A "gear ratio" can now be provided by giving the toothed wheels different diameters so as to produce a greater or smaller change in the orientation of the pair of guide arms relative to the vehicle to thus be able to adapt them to the "geometry" particularly for the region of the emptying position 25'.

FIG. 3 additionally shows that, in the rest position 25' shown in dashed lines, device 23 as a whole can be pivoted within the area given by side walls 13 above driver's cab 1. Thus it is possible, as already described above in connection with FIG. 1, to completely cover device 23 after covering 15 has be closed for purely traveling operation.

Figure 4:
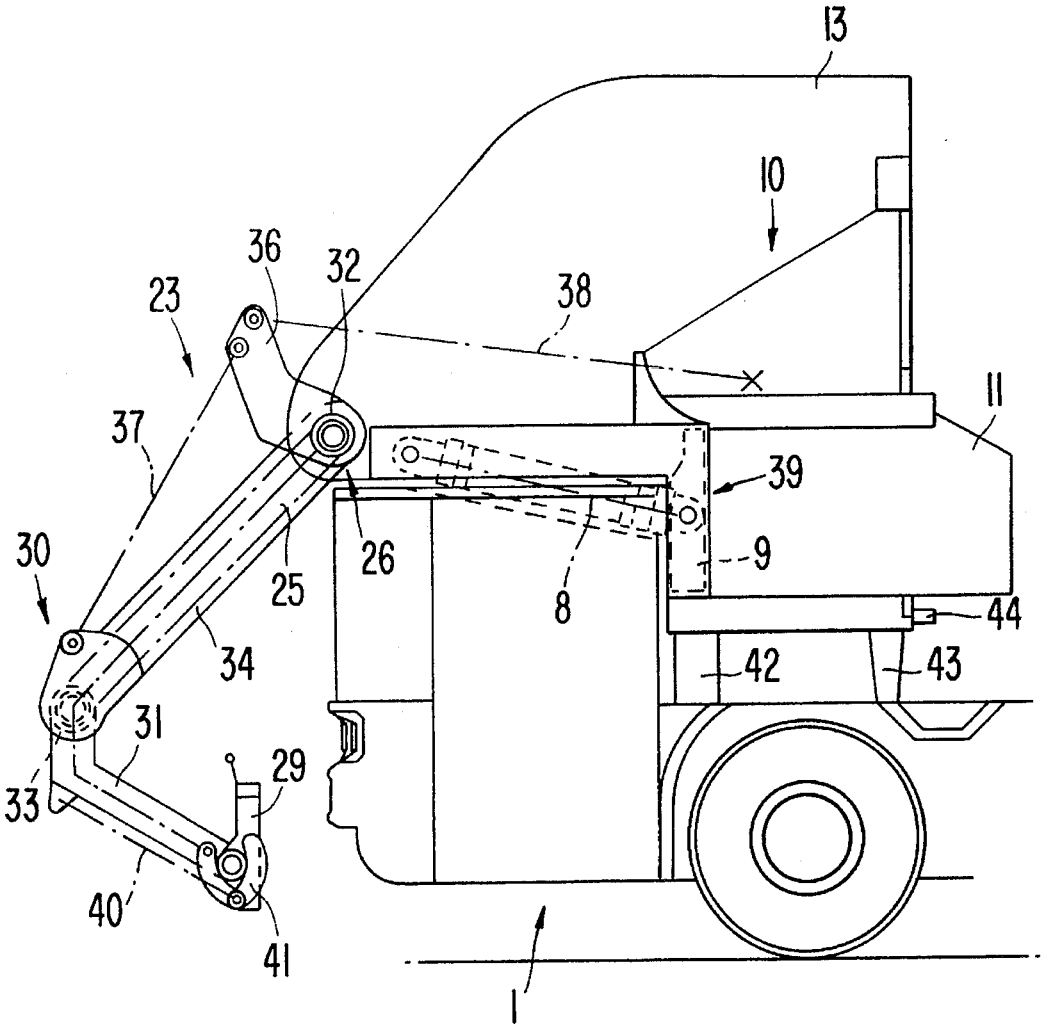
FIGS. 4, 5*a*, 5*b*, and 6*a*, 6*b* depict the structural configuration and the manner of operation of a modified embodiment of the pivot arms according to FIG. 3.
Figure 5A:
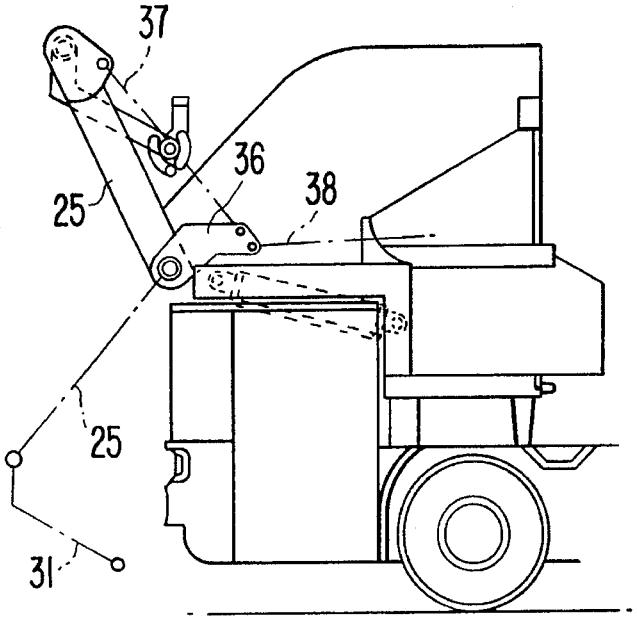

FIG. 4 shows, to a larger scale and in more detail, the embodiment whose basic structure was described in FIG. 3. Coinciding components are given coinciding reference numerals. FIGS. 5*a*, 5*b*, 6*a* and 6*b* then show the sequence of movements of device 23 up to the emptying position for a picked up refuse container 24. FIG. 6*b* then shows the driving position.

Each pivot arm of the pair of pivot arms 25 has an associated additional pivotal lever 36 in the region of pivot bearing 26. By way of a second pivoting drive 37 in the form of a hydraulic cylinder, additional lever 36 is connected with the free end 30 of the associated pivot arm. Additional lever 36 is also connected with the vehicle, in each case by way of a first pivoting drive 38 which is likewise configured in the form of a hydraulic cylinder; preferably it is connected with a beam 39, whose configuration will be described in greater detail below, for pivot bearing 26. The hydraulic cylinders are shown only by their dotted action lines. If now the first pivoting drive 38 is charged, the pair of pivot arms 25 pivot up as shown in FIG. 5*a*. If then the second pivoting drive 37 is charged, the pair of pivot arms 25 pivots the emptying position shown in FIG. 5*b*. The second pivoting drive 37 is here dimensioned in such a way that the pair of pivot arms 25 can be pivoted by way of additional lever 36 beyond the emptying position completely into the region of partitions 13 as this is shown in FIG. 6*b*. From the sequence of movements shown in FIGS. 4, 5 and 6, where FIGS. 5*a* and 5*b* each indicate the starting position in dash-dot lines, it can be seen that the pair of guide arms 31 together with the pivotal pickup and dumping device 29 supported between the free ends of the pair of guide arms 31 and the refuse container 24 connected therewith are able to pivot through a region between the pair of pivot arms 25. Due to the fact that the arms of the pair of guide arms 31 are angled downward, as can be seen in FIG. 4, shearing during upward pivoting is prevented in the region accessible from the ground.

If the above described hydraulic pivoting motor is employed, hydraulic cylinders 37, 38 and their corresponding stop elements are of course not required. The hydraulic pivoting motor is fastened directly to beam 39 coaxially with pivot bearing 26, so that its shaft acts directly on pivot arm 25. If necessary, it is advisable to provide two hydraulic pivoting motors which each drive one arm of the pair of pivot arms 25.

Figure 5B:
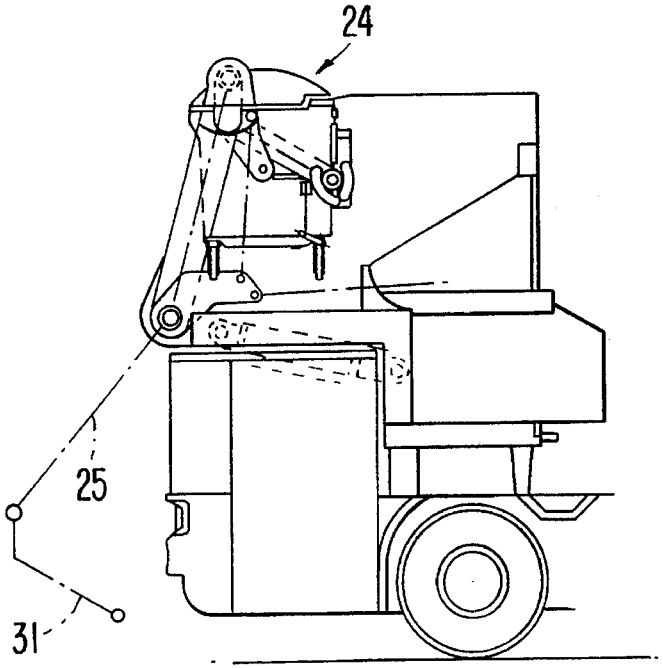
Figure 6A:
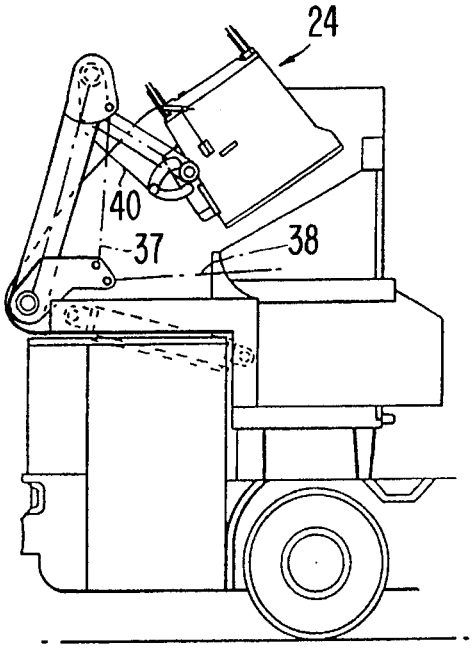
Figure 6B:
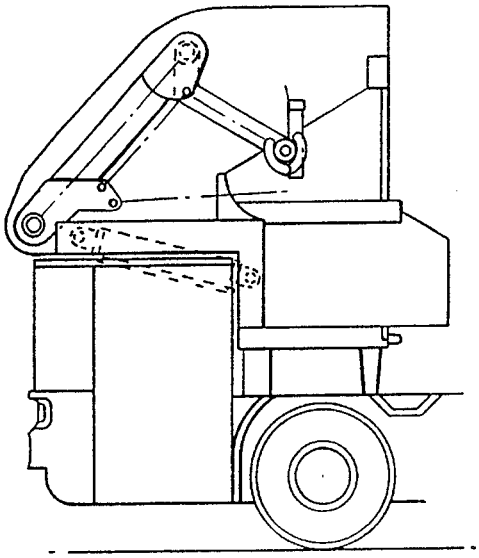

As indicated by the sequence of functions in FIGS. 4, 5*a* and 5*b*, the pair of guide arms 31 remains, by way of the chain 34 which constitutes the guide means, oriented at a constant angle relative to the horizontal during the entire pivoting movement so that accordingly a refuse container connected therewith also remains in a vertical orientation. In order to be able to tip refuse container 24, the pickup and dumping device 29 which is rotatably mounted between the free ends of the pair of guide arms 31 is connected with a tipping drive 40 in the form of a hydraulic cylinder whose one end is mounted to the pair of guide arms 31 and whose other end is articulated by way of a pair of transfer levers 41 to the pickup and dumping device 29. Only after the device has reached the emptying position shown in FIG. 6*a*, will tipping drive 40 pivot the refuse container 24 into the illustrated dumping position while appropriate carriers simultaneously open the covering.

FIG. 4 further shows schematically the manner in which beam or support 39 is fastened to the vehicle. In the illustrated embodiment, this is done by means of a three-point support at the drive mechanism, with a transverse beam 42 being disposed immediately behind the driver's cab 1. This transverse beam is fixed to the vehicle chassis by way of two juxtaposed fastening points. The third fastening point is provided at a distance behind transverse beam 42, namely by way of a centrally disposed support 43 which is articulated to the vehicle chassis. This articulation point lies in the longitudinal center axis of the vehicle chassis, which cannot be shown here, and may be constituted of a single-axis joint as well as a ball joint. Thus it is possible for the vehicle chassis to experience torsion about its longitudinal axis without secondary bending occurring between the point of fastening of the transverse beam 42, on the one hand, and the point of articulation 43 on the other hand.

In FIG. 4, beam 39 is shown only schematically. However, in a practical embodiment, the beam is configured as a box structure, with the pouring chute 10 as well as partial regions of side walls 13 being configured as supporting elements as well so that here a structure of relatively low weight results which has high rigidity. For reasons of simplifying the drawing, the front side wall is removed in FIG. 4 so that the arrangement of the components lying between side walls 13 is visible. FIG. 4 also shows that the thus designed beam 39 can simultaneously also be utilized for fastening the pressing cylinder 8 and to guide pressure ram 9. Preferably at least two juxtaposed locking lugs 44 are arranged at beam 39, below the extension 11 of the discharge opening of pouring chute 10 so as to engage in corresponding recesses in the collecting container to be connected to thus practically rigidly lock the collecting container 2 in conjunction with hook-shaped locking elements, not shown in detail here, and substantially exclude relative movements between the extension 11, on the one hand, and the collecting container 2, on the other hand, at least in the region in which extension 11 projects into collecting container 2.

Figure 7:
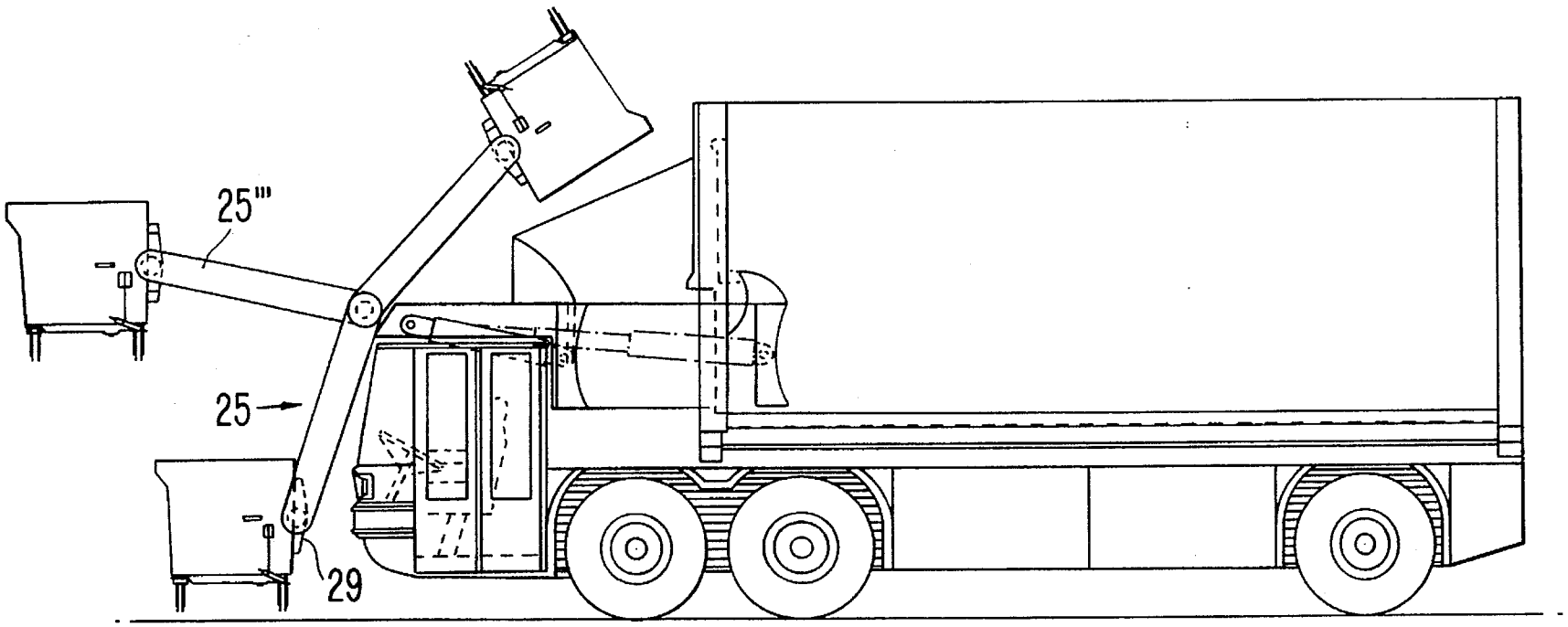
FIG. 7 depicts a further embodiment of the pair of pivot arms.

FIG. 7 shows a simplified form of device 23. This is here composed merely of a pair of pivot arms 25 between whose free ends the pickup and dumping device 29 is rotatably mounted. The arrangement is here such that a guide means, for example a chain guide 32, 33, 34 as described in connection with FIG. 3, takes care that the picked up refuse container 24, as shown in its intermediate position 25''', remains in a vertical orientation during the entire pivoting process. Only the pickup process, shown in the lowermost position, and the emptying process, shown in the uppermost position, are then accomplished by way of a tipping drive arranged between the pair of pivot arms 25 and the pickup and dumping device. The illustration in FIG. 7 shows that the clearance profile given by collecting container 2 is not noticeably exceeded during the emptying process.

Figure 8:
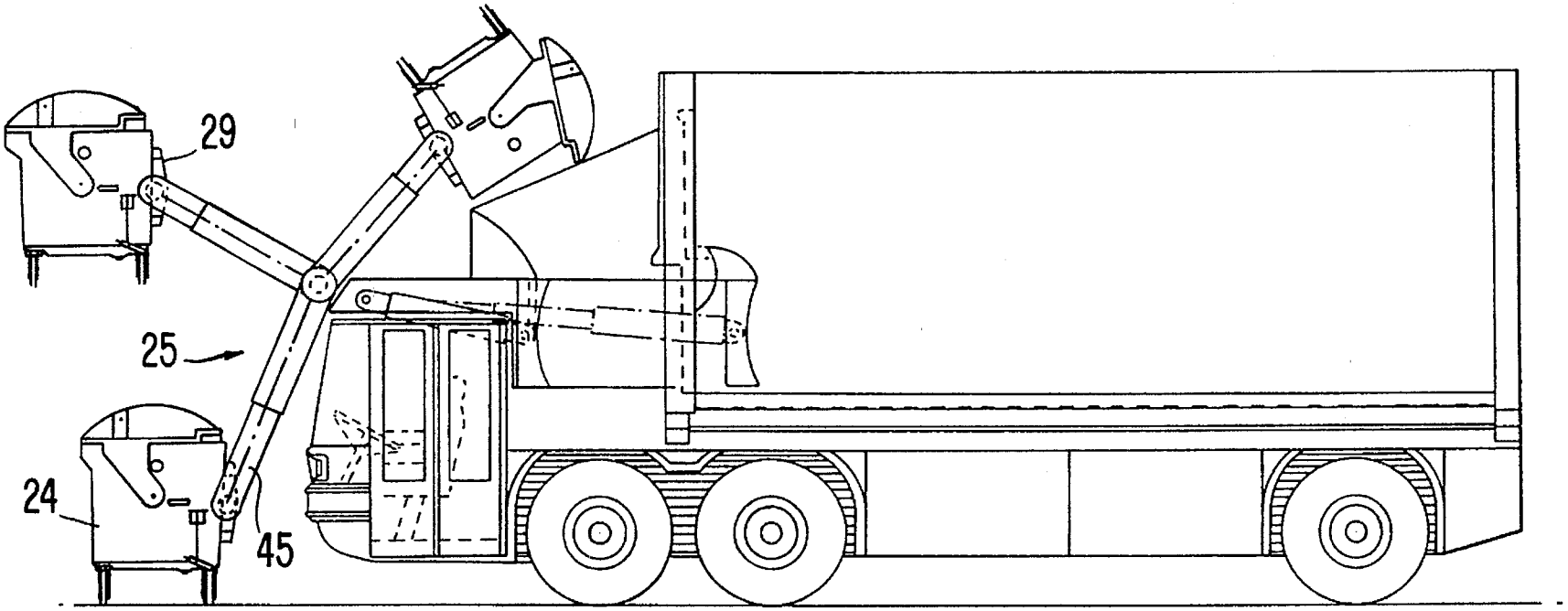
FIG. 8 depicts an embodiment of the pair of pivot arms in telescope form.

FIG. 8 shows a modification of the embodiment of FIG. 7. The pair of pivot arms 25 is here provided with extensions 45 that are guided in the manner of a telescope and to which the pickup and dumping device 29 is fastened as described above. Here again guide means are provided which take care that the refuse container 24 remains in a vertical orientation during the pivoting process until it reaches the emptying position. These guide means will be described in greater detail in connection with FIG. 16.

Figure 9:
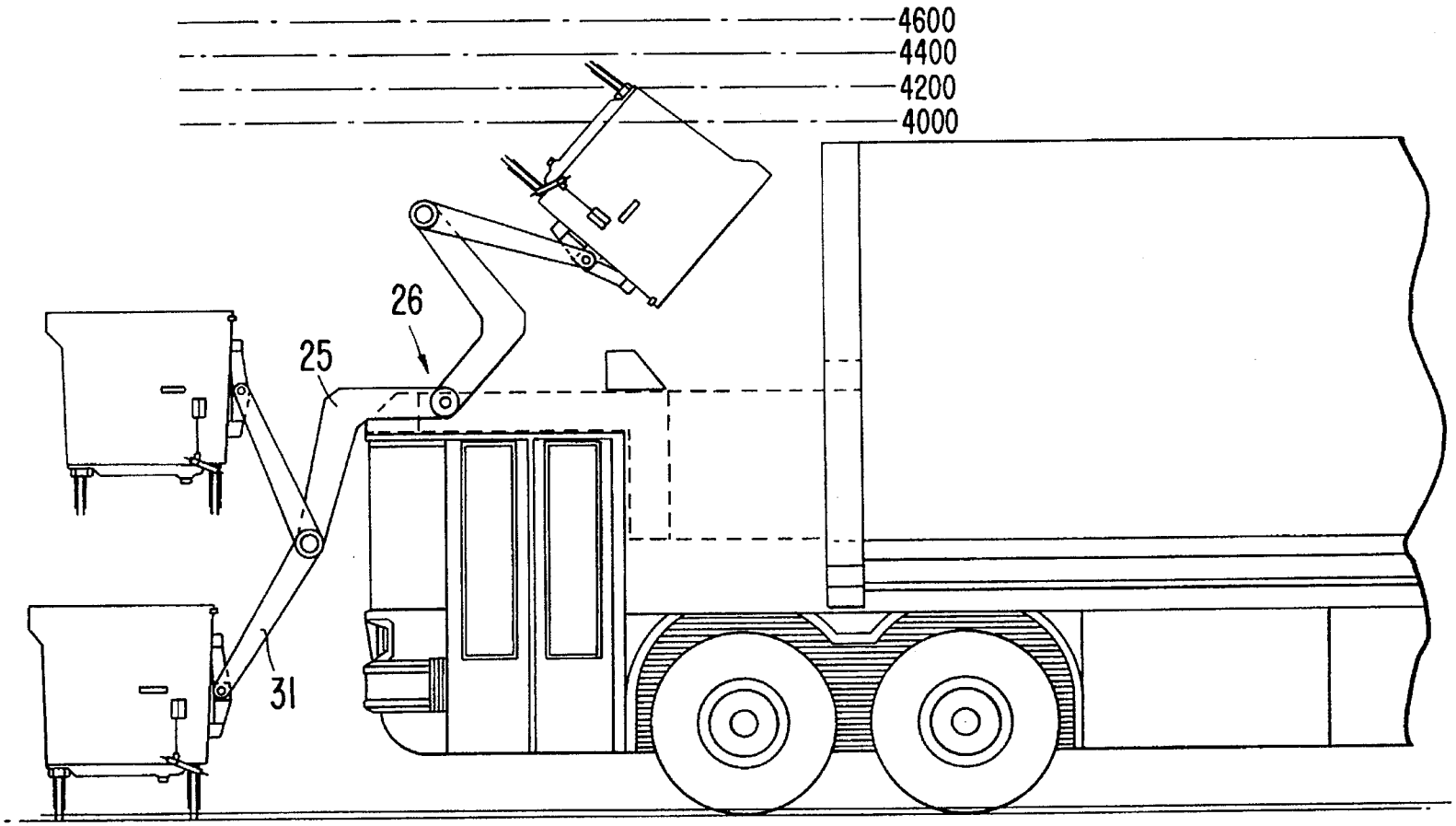
FIG. 9 depicts a modified embodiment of the pair of pivot arms in an angled configuration.

FIG. 9 depicts a further embodiment in which the pair of pivot arms 25 is angled downwardly with respect to the pickup position. Again, the free ends of the pair of pivot arms 25 are then each provided with a pair of guide arms 31 whose free ends are again fastened to the pickup and dumping device 29. The pivoting movement takes place in such a way that initially the pair of guide arms 31 are pivoted upward into the illustrated intermediate position so that the total pivoting radius between the rotation axis of the pickup and dumping device 29, on the one hand, and the pivot bearing 26, on the other hand, is correspondingly shortened. Then the pair of pivot arms 25 are pivoted into the emptying position, with again the refuse container 24 remaining in a vertical orientation until the pair of pivot arms has reached the emptying position. Only then is the tipping drive actuated so that the refuse container 24 is pivoted into the illustrated emptying position. The clearance required for this embodiment is somewhat greater than the height required for the embodiment according to FIG. 4, since here the pair of guide arms are pivoted upward away from the vehicle before the pair of pivot arms are pivoted about pivot bearing 26. In contrast thereto, in the embodiment according to FIG. 4, the pair of guide arms are pivoted toward the vehicle between the pair of pivot arms 25.

Figure 10B:
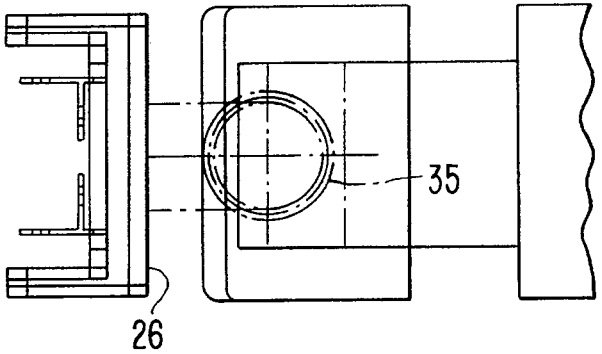
FIGS. 10*a*)–10*d*) depict the configuration and operation in different operating positions of a pair of pivot arms that are mounted so as to be displaceable and rotatable in the horizontal plane.
Figure 10D:
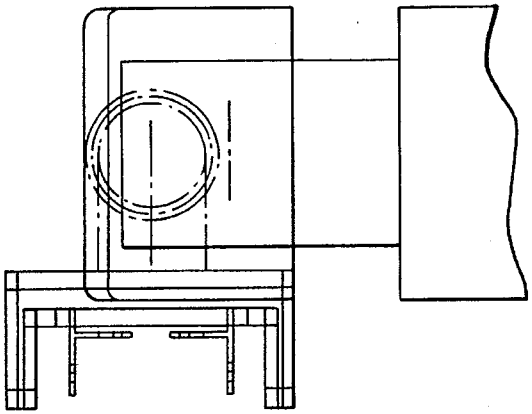
Figure 10A:
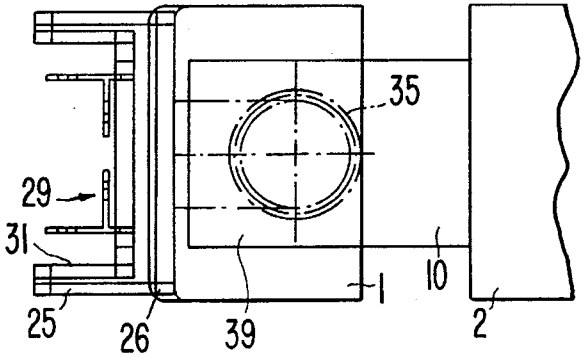
Figure 10C:
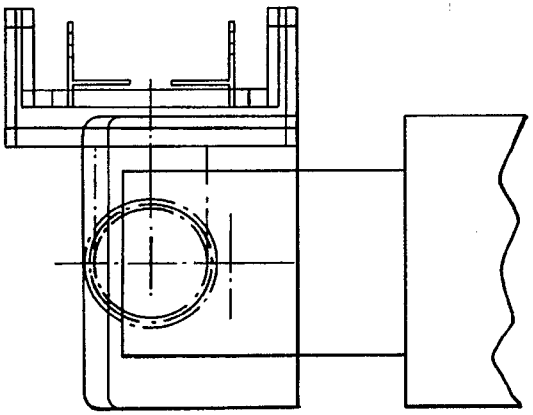

FIG. 10*a*) is a schematic top view of the front region of the vehicle described in connection with FIG. 3. It can be seen here that the pair of guide arms 31 together with the pickup and dumping device 29 are disposed between the pair of pivot arms 25 and are able to pivot through between the two pivot arms 25 during the pivoting process. The top view in FIG. 10*a*) shows the position of the pair of pivot arms 25 in the pickup position near the ground. Pouring chute 10 and collecting container 2 are shown schematically.

Another modification of the system described in connection with FIG. 3 will now be described in connection with FIG. 10. Here, the pivot bearing 26 of the pair of pivot arms 25 is connected with beam 27 by way of a rotary bearing 35 which in turn is connected with beam 27 so as to be displaceable in the longitudinal direction of the vehicle.

While FIG. 10*a*) shows the position of the pair of pivot arms 25 and its pivot bearing 26 relative to the vehicle, as it also exists in a rigid embodiment according to FIG. 3, FIG. 10*b*) is a schematic illustration of the above-described possibility of displacing the pivot bearing 26 connected with rotary bearing 35 toward the front when seen in the longitudinal direction of the vehicle. To simplify the illustration, the connection of pivot bearing 26 with rotary bearing 35 is not shown here. Thus it is possible to arrange pivot bearing 26 as deeply as possible in the front region above driver's cab 1 since the provided displaceability now allows the entire arrangement to be pivoted to the right (FIG. 10*c*)) and to the left (FIG. 10*d*)) side of the vehicle. Thus it is also possible to pick up refuse containers that are standing along the side of the road. After a container standing on the side has been picked up, the arrangement is pivoted back into the front region and moved back into its original basic position shown in FIG. 10*a*) whereupon the refuse container is emptied into the pouring chute over the top of the driver's cab.

The illustration and description of FIG. 10 further leads to another modification. If now, with beam 27 in an appropriate configuration, the rotary bearing 35 is connected with beam 27 so as to be displaceable not only in the longitudinal direction of the vehicle but also transversely to the longitudinal direction of the vehicle, it can easily be seen that it is possible to reach an advanced position of pivot bearing 26 and the pair of pivot arms 25 corresponding to FIG. 10*b*) also for one of the two lateral positions corresponding to FIGS. 10*c*) and 10*d*), respectively. Since in this case the rotary bearing can be displaced out of its central position toward the right as well as toward the left side of the vehicle, this modification allows the refuse container picked up on the one side of the vehicle to be pivoted transversely to the longitudinal axis of the vehicle over the top of the driver's cab and to empty the picked up refuse container into a collecting container disposed on a second vehicle, for example a trailer, that is disposed next to the pickup vehicle. With the aid of the transverse displaceability of rotary bearing 35 it is then possible to bridge the necessary changes in distance.

Figure 11:
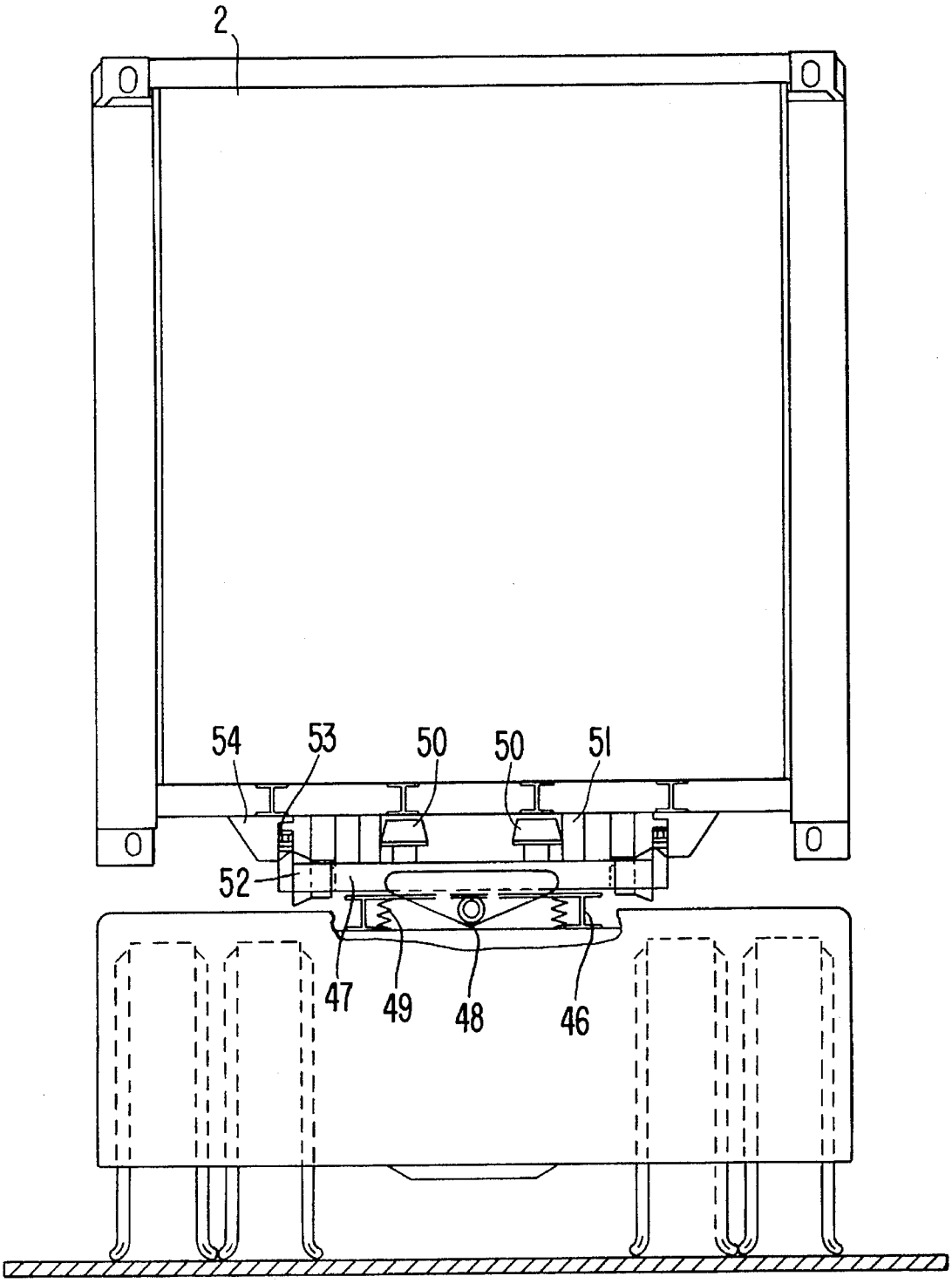
FIG. 11 depicts the support of the collecting container at the end of the vehicle.

FIG. 11 shows, in a view toward the rear of the vehicle, the support of collecting container 2 in the region of the rear end of vehicle chassis 46. For this purpose, a transverse beam 47 is provided which serves to support and lock collecting container 2 but also to guide it during the pickup and putdown process to be described in greater detail below. Transverse beam 47 is provided with a pivot bearing 48 so that it is mounted to be pivotal about a pivot axis extending in the longitudinal direction of the vehicle. Preferably the pivot axis, which is defined by pivot bearing 48, is flush with the joint axis of the support point 43 of beam 39. In this way, it becomes possible for vehicle chassis 46 to be able to experience torsion relative to the "rigid structure" constituted of beam 39 and collecting container 2 which is firmly coupled to it. The sole rigid connection between this "rigid structure" is here constituted of the transverse beam 42 which is fixed to vehicle chassis 46 at beam 39.

Between transverse beam 47 and vehicle chassis 46 there is provided at least one positioning spring element 49 which is here drawn in only schematically. In the unstressed state, the positioning spring element causes transverse beam 47 to remain oriented parallel to the plane defined by vehicle chassis 46. Positioning spring elements 49 are here made relatively soft so that the vehicle chassis 46 is able to experience torsion without the noticeable exertion of force between transverse beam 47 and vehicle chassis 46.

Two guide rollers 50 are provided at transverse beam 47. They are mounted to the transverse beam so as to rotate about vertical axes and guide the collecting container over appropriate longitudinal beams at collecting container 2 in the longitudinal direction when the latter is being picked up and put down. Also provided at transverse beam 47, at each one of its outer ends, are so-called bell rollers 52 which are mounted so as to rotate about a horizontal axis and on which collecting container 2 is supported after it is picked up by the vehicle so that the rear end of collecting container 2 is able to roll on bell rollers 52 when collecting container 2 is moved over carriage 18 into the locking position as described in connection with FIG. 2.

Also connected with transverse beam 47 are two rearwardly oriented locking hooks 53 that engage in corresponding recesses 54 at collecting container 2 so that the rear end of the container is also form-lockingly locked with transverse beam 47 if the front end with its locking lugs 44 at beam 39 is tightly locked by way of locking hooks that are not shown here in detail.

Figure 13:
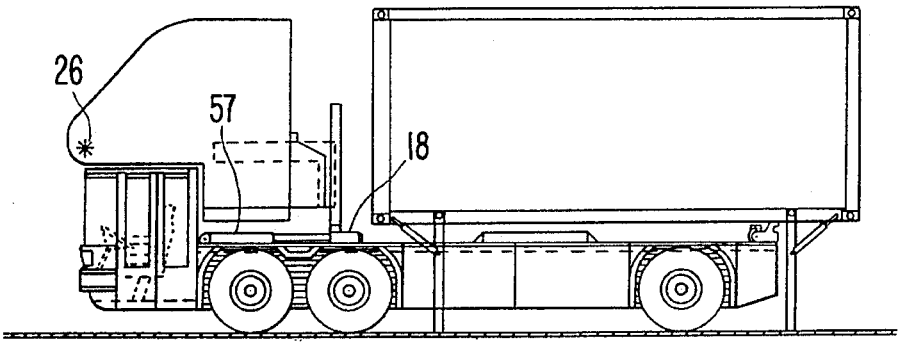
Figure 14:
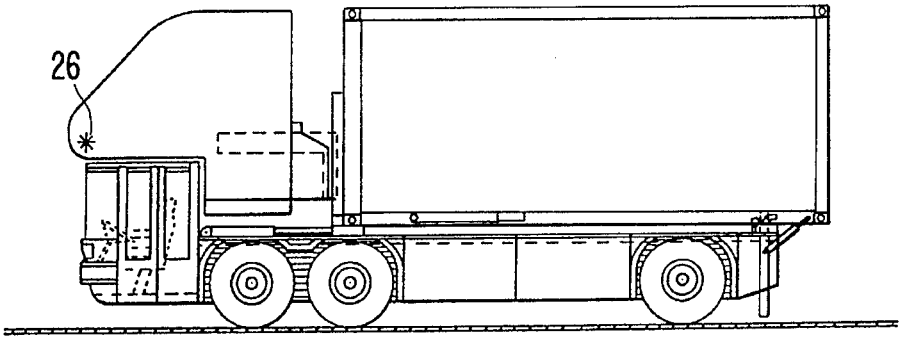
Figure 15:
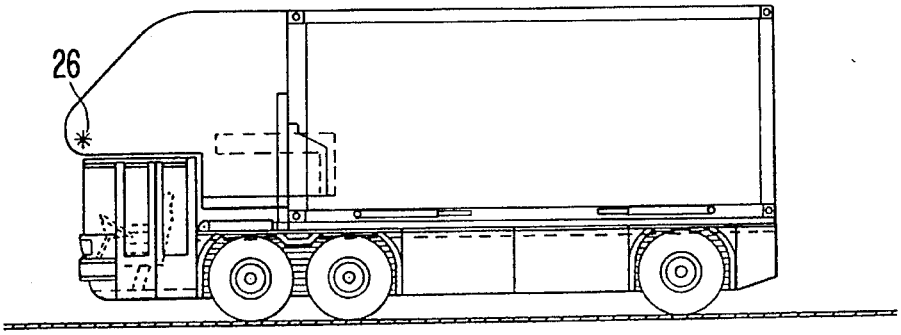

The pickup process will be described in greater detail with reference to FIGS. 12, 13, 14 and 15. To pick up a collecting container 2 provided with pivotal legs 55, a vehicle equipped for so-called exchangeable beds is employed which can be lowered as a whole by means of hydraulic or pneumatic systems. To accomplish this, the vehicle backs up underneath collecting container 2 as shown in FIG. 13 to the point where the front wall of the collecting container comes in contact with an appropriate stop at carriage 18 which has been moved completely to the rear. Then, as can be seen in FIG. 14, the vehicle is raised to its normal position so that the front end of collecting container 2 is connected with corresponding lugs 3 at carriage 18 while simultaneously the carriers 21 at operating device 19 engage in the shutoff door at collecting container 2. At the same time, the rear end of collecting container 2 is supported on bell rollers 52. Once the shutoff door has been opened by operating device 19 and the rear legs 55 have also been pivoted up, collecting container 2 is pushed forward into its final position on the vehicle by way of carriage 18 as shown in FIG. 15. This causes extension 11 to be introduced into the interior of the container as shown and described in FIG. 3. At the same time, the container is locked by means of the locking lugs 44 at beam 39 shown in FIG. 4 and the locking hooks 53 at the rear end of the vehicle are locked. In the illustrated embodiment, carriage 18 is displaced by way of a piston-cylinder unit 57 fastened horizontally at the vehicle.

FIG. 15 shows the vehicle ready for travel and use, with the device 23 for picking up and emptying refuse containers being indicated, for the sake of simplifying the illustration, only by pivot bearing 26.

The description of the operating sequence in connection with FIGS. 4, 5 and 6 shows the multitude of possible uses. With the appropriate configuration of pickup and dumping device 29, refuse containers 24 of the most varied structures and sizes can be picked up. It is also possible to hang several small refuse containers next to one another on the pickup device and to then empty them simultaneously.

The vehicle can also be used for a so-called bag removal system. In this case, a large-volume receiving container is fastened to the pickup device into which the bags are then thrown. Short trips can then also be made with the pair of pivot arms set down since they do not block the driver's view. In the same manner it is possible to collect bundled waste paper, particularly newspapers. Small refuse or ash cans can then be emptied manually into the receiving container which is emptied into collecting container 2 only after it is filled to a substantial degree.

A vehicle of such a design has the further advantage that collecting container 2 constitutes a naked steel structure and that no drives are arranged at collecting container 2 itself. Therefore, no connecting means for the supply of energy need be provided. All actuating means including their associated energy supplies are connected with the vehicle. This reduces the costs and the need for repairs for the collecting container and also permits the manipulation at the dump, particularly the dumping, to be accomplished by means of a special dump vehicle. The collecting containers may thus also be put down without supervision.

Figure 16:
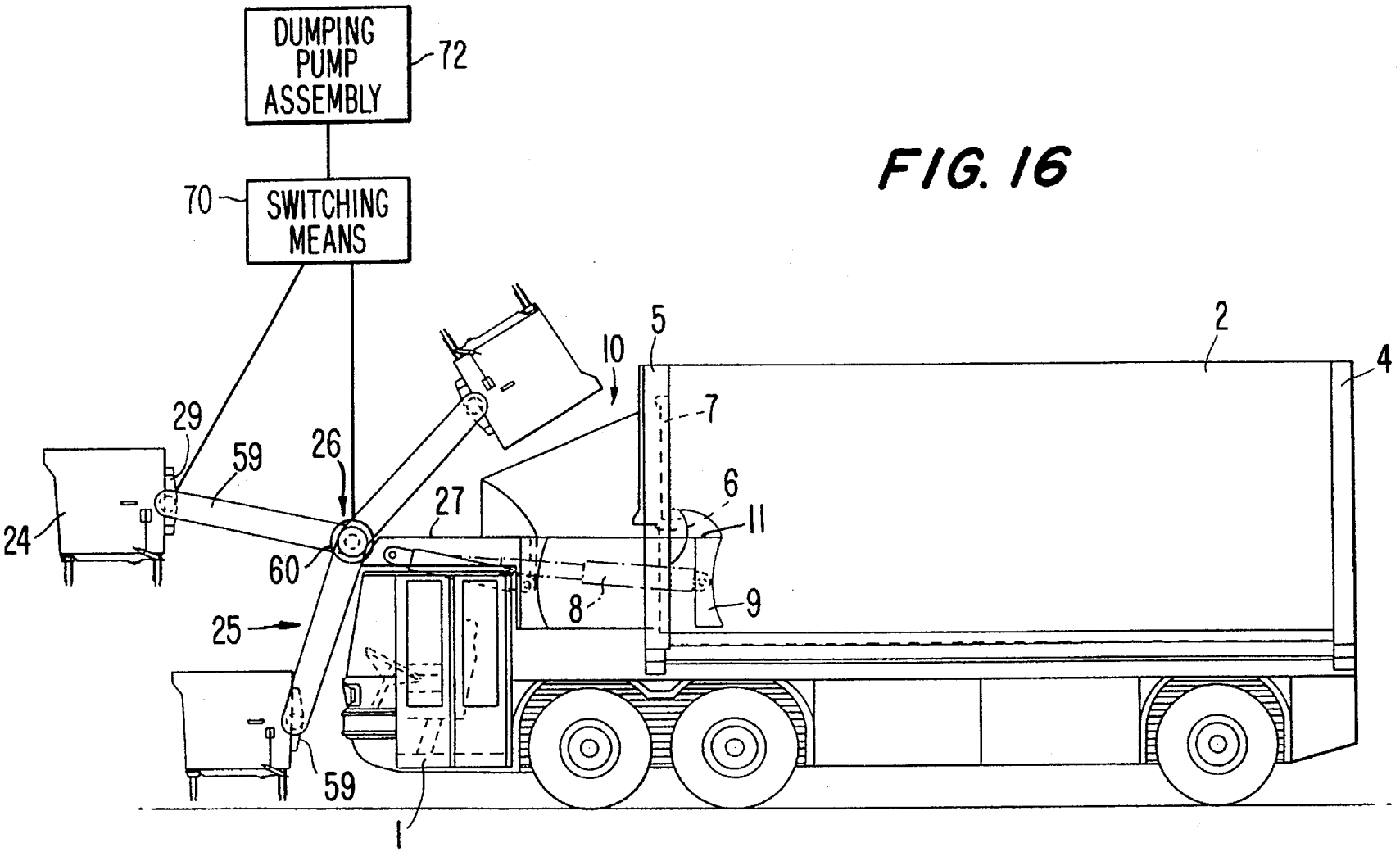
FIG. 16 depicts a modified embodiment of a vehicle according to FIG. 8.

The vehicle shown in FIG. 16 corresponds in its basic structure to the above described vehicles. To pick up and empty a refuse container 24, a pivoting device 25 in the form of a pair of pivot arms is now provided at the vehicle, with the pivot arms being arranged parallel to one another and spaced from one another at a distance which approximately corresponds to the width of driver's cab 1. The pair of pivot arms 25 and a pivot bearing 26 are arranged at a beam 27 in the front region above the driver's cab 1, with a pivoting drive being provided which is not shown in detail and is configured in such a manner that the pair of pivot arms can be pivoted over an angle of approximately 180 degrees from the illustrated lower pickup position into the illustrated upper emptying position. The pivoting drive may here be constituted of one or a plurality of coupled hydraulic piston-cylinder units, with the required pivot angle being realized by means of appropriate lever arrangements or also by means of a hydraulic pivoting motor.

A pickup and dumping device 29 for refuse container 24 is mounted at the free end of the pair of pivot arms so as to pivot about a horizontal axis. In order to keep refuse container 24 in a vertical orientation over the entire pivoting path of the pair of pivot arms 25, a drive means in the form of an oil motor or a hydraulic pivoting motor 59 is provided in the illustrated embodiment at the pair of pivot arms 25. This drive means is in communication by means of pipe conduits with a correspondingly dimensioned pump assembly 60 disposed in the region of pivot bearing 26. This is practically an assembly of the same structure with the only difference that here the drive is imparted by way of the rotor shaft so that this oil motor operates as a pump. During a pivoting movement of arm 25 the oil motor 59 is now driven—as can be seen in the drawing—in synchronism with the pivoting movement of the pair of pivot arms 25. Synchronism here means that the pickup and dumping device 29 is rotated at the same angular velocity as the pivoting device but in the opposite direction to it. Only after the pivoting device has reached the upper emptying position, will an appropriate switch be made by way of reversing means or switching means 70 to the dumping pump assembly 72 to charge oil motor 59 with pressure oil so that then the initially still vertically oriented receiving container is pivoted into the illustrated emptying position. Finally, refuse container 24 is pivoted back again into the vertical orientation and the pair of pivot arms is pivoted back again into the receiving position.

Figure 17:
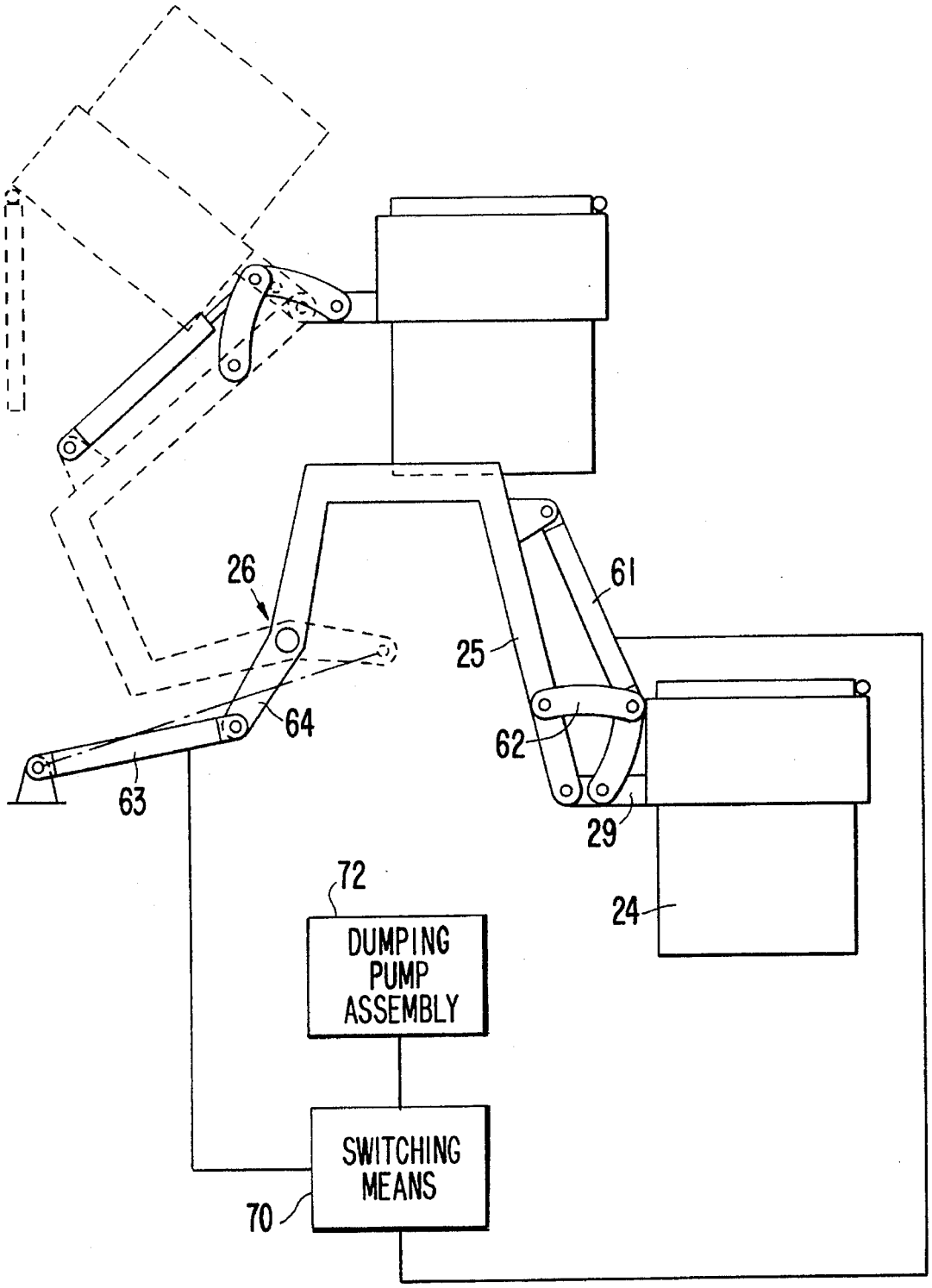
FIG. 17 depicts an embodiment for vertical guidance.

While in the embodiment shown in FIG. 16 the pivot bearing for pivoting device 25, that is, in the case of the embodiment, one pair of pivot arms is fastened in the upper front region of the driver's cab, FIG. 17 is a side view of an embodiment for a pair of pivot arms in which the pivot bearing 26' is fixed directly at the vehicle chassis in a region behind the driver's cab. Pivot arms 25 are here given a U shape and follow approximately the outline of the sides of the driver's cab so that, in the pickup position for refuse containers, free access to the driver's cab is ensured. In this embodiment, a hydraulic piston-cylinder unit 61, which is connected with the pickup and dumping device 29 by way of a set of transmission rods 62, is provided in the illustrated manner on each one of the two pivot arms 25 as the drive means for the pickup and dumping device 29.

A correspondingly dimensioned hydraulic cylinder 63 is disposed at the vehicle and is connected with pivot arm 25 in the region of the pivot bearing, for example by way of an appropriate extension arm 64, so that the pivoting movement of pivot arm 25 can be translated directly into a movement of the piston. The hydraulic cylinder 63 serving as the pump assembly, here a dual-action hydraulic cylinder, is in communication by way of appropriate pipe conduits for intake and discharge with the likewise dual-action hydraulic cylinder 61 so that each pivoting movement of the pair of pivot arms 25 is directly converted into a synchronous pivoting movement of pickup and dumping device 29, that is, the latter is pivoted at the same pivoting speed but in the opposite pivoting direction relative to the pair of pivot arms 25 so that the refuse container 24 remains in an essentially vertical orientation over the pivoting path.

When the end position is reached, an appropriate reversing means or switching means 70 here again permits switching to a different pressure oil supply of dumping pump assembly 72 so that then cylinder 61 is charged with pressure oil in such a way that refuse container 24 is pivoted toward the fill opening and thus can be emptied.

Figure 18:
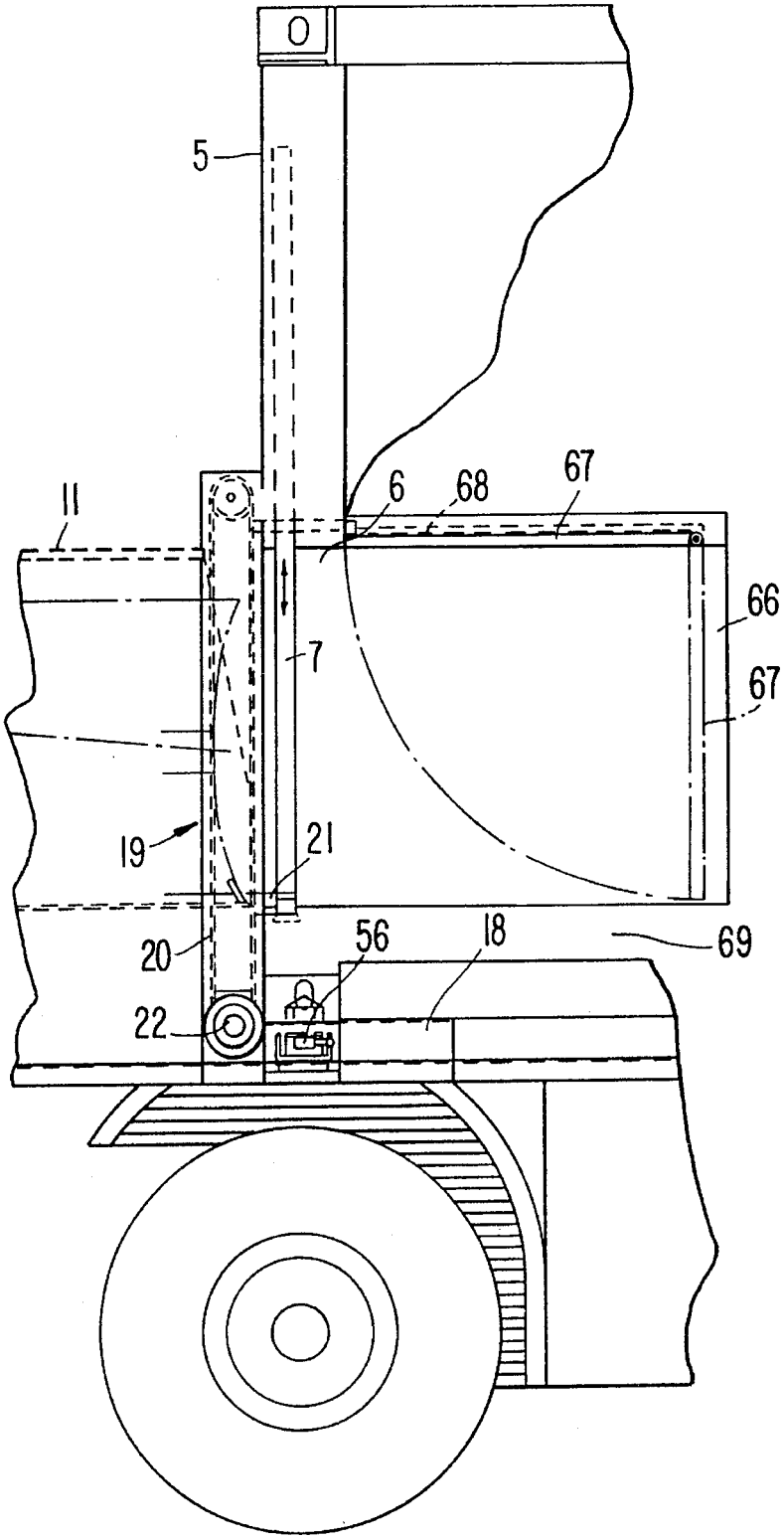
FIG. 18 is a detail view of the connection between press and collecting container.

FIG. 18 is a schematic illustration of one embodiment for a check plate 67 with which a closure, preferably an additional closure, of fill opening 6 is possible. For this purpose, a channel-like protective covering 66 is provided in the interior of collecting container 2 so as to extend into the interior as an extension of fill opening 6. In the region of its rear end, check plate 67 is preferably articulated so as to be pivoted down from the top. Check plate 67 is provided with actuation and/or closing means 68 which can be actuated from the exterior of the container, for example by way of operating device 19.

After collecting container 2 has been picked up by the vehicle (FIG. 14) as described in connection with FIGS. 12 to 15, check plate 67 is also pivoted upward when the shutoff door is opened as shown in FIG. 18. As soon as collecting container 2 is filled, pressure ram 9 is retracted and the lock is released by operating device 19 so that check plate 67 drops downward on its hinge. With the aid of pressure ram 9, check plate 67 is then urged into its end position. Residual quantities of refuse are thus pressed out of the channel-like protective covering 66 into the collecting container. After the check plate has been locked, pressure ram 9 is retracted so that the collecting container can be moved back without any residual quantities of refuse being able to drop out before door 7 is closed; this is shown in FIG. 18 in dash-dot lines. Check plate 67 may also be made of two parts so as to pivot about vertical axes from each of the side walls of protective covering 66 into the opening cross section. With the check plate configured accordingly, particularly if there is a sufficient seal, the arrangement of the check plate may be sufficient to close the fill opening so that the arrangement of the shutoff door 7 at the collecting container as described in connection with FIG. 2 can be dispensed with.

It is advisable for the protective covering 66 to be provided with a slight slope down into the interior of the collecting container at least with respect to the final length of its bottom surface. The clearance 69 underneath the protective covering may serve as a collection chamber for seepage fluids. If the front wall 5 is simultaneously configured as an emptying flap for the collecting container, no remainders are able to collect in this region.

The configurations according to the invention of the vertical guide for refuse container 24 include either a hydraulic drive, preferably comprising at least one oil motor connected with the pickup and dumping device, or at least one hydraulic cylinder connected with both the pivoting device and the pickup and dumping device, preferably by transmission rods. These configurations are not limited to vehicles equipped with the arrangement of the pair of pivot arms according to the invention, but can be used in principle for all so-called front-end loaders equipped with pivot arms for moving containers that are to be emptied, in which the containers are emptied over the top of the driver's cab by dumping their contents into a collecting container disposed behind the driver's cab.

The embodiments according to the invention of the coupling of the discharge opening of the press with the collecting container to be filled is not limited to a vehicle of the type according to the invention but can be employed for all vehicles equipped with a trash compacting device and an associated collecting container that can be released from the vehicle.

I claim:

1. A vehicle for picking up and transporting refuse including:

a vehicle chassis;

a driver's cab connected to the chassis;

a movable collecting container positioned behind the driver's cab and having a fill opening at an end thereof disposed near the driver's cab;

a support connected to the vehicle chassis behind the driver's cab and being separate from the movable collecting container;

a dumping means for picking up at least one refuse container in front of a front end of the vehicle and moving the at least one refuse container over the driver's cab for emptying the at least one refuse container in the fill opening behind the driver's cab thereby defining a pickup position, a dumping trajectory, and an emptying position of the refuse container, the dumping means including:

a pivot bearing for a pair of pivot arms;

a pair of pivot arms having first ends and second ends and pivotally connected to the pivot bearing at first ends thereof;

a pick up and dumping device connected to the pivot arms;

wherein the pivot bearing for the pair of pivot arms is fastened to the support in an upper front region of the driver's cab.

2. The vehicle according to claim 1, wherein the dumping means further includes a pivoting drive means connected between the vehicle and the pair of pivot arms for pivoting said pair of pivot arms from the pickup position where the pickup and dumping device is positioned for picking up the refuse container from the front of the vehicle, to the emptying position where the pickup and dumping device is positioned for emptying contents of the refuse container in the region of the fill opening.

3. The vehicle according to claim 2, wherein the drive means comprises a hydraulic piston-cylinder arrangement.

4. The vehicle according to claim 3, wherein the hydraulic piston-cylinder arrangement includes:

a pivotal lever disposed at the pivot bearing;

a first pivoting drive comprising a first hydraulic piston-cylinder unit connecting the pivotal lever to the support; and a second pivoting drive comprising a second hydraulic piston-cylinder unit connecting the first pivotal lever to the second ends of the pair of pivot arms such that successive charging of the first pivoting drive and the second pivoting drive effects pivoting of the pair of pivot arms between the pickup position and the emptying position.

5. The vehicle according to claim 4, wherein the first pivoting drive connects the pivotal lever to the support.

6. The vehicle according to claim 2, wherein the drive means comprises a hydraulic pivoting motor fastened directly to the support coaxially with the pivot bearing.

7. The vehicle according to claim 6, wherein the hydraulic pivoting motor includes:

a shaft element including a housing having a first helical thread therein;

a piston element nested in the housing in a telescoping manner and having a second helical thread thereon adapted to cooperate with the first helical thread in the housing; and hydraulic means for effecting an axial displacement of the piston element, the first helical thread and the second helical thread cooperating to impart a rotary movement to the piston element during its axial displacement.

8. The vehicle according to claim 2, wherein the drive means comprises a hydraulic drive comprising at least one oil motor connected with the pickup and dumping device.

9. The vehicle according to claim 2, wherein the drive means includes:

at least one hydraulic cylinder connected with the pair of pivot arms and with the pickup and dumping device; and a set of transmission rods for connecting the hydraulic cylinder with the pair of pivot arms and with the pickup and dumping device.

10. The vehicle according to claim 2, and further including a first pump assembly connected to the drive means and being effective for controlling the drive means to establish synchronism between a pivoting of the pickup and dumping device and a pivoting of the pair of pivot arms during the entire dumping trajectory of the refuse container.

11. The vehicle according to claim 10, and further including a second pump assembly connected to the drive means and being effective for controlling the drive means to tip the pickup and dumping device for emptying the refuse container into the movable collecting container once the refuse container has reached its emptying position.

12. The vehicle according to claim 11, and further including a switching means for tipping over the picked up refuse container, the switching means being connected to the first pump assembly, the second pump assembly, and the drive means for switching control of the drive means from the first pump assembly to the second pump assembly once the refuse container has reached its emptying position, and from the second pump assembly back to the first pump assembly once the refuse container has been emptied into the movable collecting container.

13. The vehicle according to claim 1, wherein the pickup and dumping device is connected with the pair of pivot arms for picking up the refuse container so as to be rotatable about a horizontal axis, the vehicle further including:

drive means connected with the pair of pivot arms for keeping the refuse container connected with the pickup and dumping device in an approximately vertical orientation during the dumping trajectory of the refuse container; and controllable means for tipping over the picked up refuse container.

14. The vehicle according to claim 1, and further including means in communication with the pair of pivot arms for effecting a shortening of a total radius defined by the dumping trajectory of the picked up refuse container at least in a region above the driver's cab.

15. The vehicle according to claim 14, wherein the means for effecting a shortening of the total radius comprise extensions telescopingly guided at the pair of pivot arms.

16. The vehicle according to claim 14, wherein the means for effecting a shortening of the total radius comprise a pair of guide arms connected with the second ends of the pair of pivot arms.

17. The vehicle according to claim 16, and further including:

means for pivoting the pair of guide arms through a region between the second ends of the pair of pivot arms; and guide means for holding the pair of guide arms essentially against the vehicle and at an essentially constant angle relative to a horizontal line over the entire dumping trajectory of the refuse container.

18. The vehicle according to claim 1, wherein the support includes a beam portion and further including a rotary bearing connecting the pair of pivot arms and the pivot bearing with the beam portion of the support for pivoting about a vertical axis.

19. The vehicle according to claim 18, wherein the rotary bearing is connected with the beam portion so as to be displaceable relative to the vehicle in at least one of a longitudinal direction and a transverse direction.

20. The vehicle according to claim 1, wherein the movable collecting container is releasably connectable with the vehicle chassis and has a front wall, and wherein the fill opening of the movable collecting container is disposed at a lower region of the front wall of the movable collecting container, the vehicle further including:

a pouring chute disposed behind the driver's cab and having a discharge opening which is connectable to the fill opening of the movable collecting container, the discharge opening having a tubular extension extending into the movable collecting container through the fill opening;

sealing means for sealing the tubular extension against the fill opening; and a press for pushing refuse through the tubular extension into the movable collecting container.

21. The vehicle according to claim 20, wherein the fill opening has edges thereon, and includes a channel-like protective covering disposed in the collecting container and enclosing at least part of the edges of the fill opening, the tubular extension of the press being insertable into the protective covering.

22. The vehicle according to claim 21, wherein the channel-like protective covering is blockable by at least one check plate for covering a cross section of the fill opening.

23. The vehicle according to claim 22, wherein the at least one check plate is pivotal into the cross section of the fill opening.

24. The vehicle according to claim 22, wherein the press has an advancing direction, and wherein the check plate is mounted so as to be pivotal into the cross section of the fill opening in the advancing direction of the press.

25. The vehicle according to claim 22, and further including actuating means for actuating the check plate from a region exterior to the collecting container.

26. The vehicle according to claim 20, wherein the tubular extension of the discharge opening of the pouring chute includes an operating device having an operating drive.

27. The vehicle according to claim 26, and further including:

a shut off door disposed at the fill opening of the movable collecting container and having a detent therein; and a carrier means adapted to be engaged within the detent of the shut off door for vertically guiding the shut off door for opening and closing the fill opening of the movable collecting container.

28. The vehicle according to claim 26, wherein the operating device includes an actuating drive for actuating the check plate from a region exterior to the collecting container.

29. The vehicle according to claim 26, and further including a moving device for moving the collecting container essentially horizontally on the vehicle chassis during at least part of the dumping trajectory of the refuse container, the moving device including a moving drive.

30. The vehicle according to claim 29, wherein the operating device is disposed on the moving device.

31. The vehicle according to claim 1, and further including a three point support for fastening the support to the vehicle chassis including two juxtaposed fastening points fixed to the vehicle chassis defining a line essentially perpendicular to a longitudinal axis of the vehicle, and a third fastening point spaced from the two juxtaposed fastening points and articulated to the vehicle chassis.

32. The vehicle according to claim 1, wherein the support includes locking means for firmly coupling on the movable collecting container.

33. The vehicle according to claim 20, wherein the press includes a drive means mounted on the support and a pressure ram guided on the support.

34. The vehicle according to claim 20, wherein the pouring chute is configured to include side walls at a top region thereof which extend beyond the driver's cab into a top front region of the vehicle.

35. The vehicle according to claim 34, wherein the support is configured as a box structure partially defined by the pouring chute and side walls thereof.

36. The vehicle according to claim 34, wherein upper edges of each of the side walls include a guide for guiding a displaceable covering of the pouring chute.

37. The vehicle according to claim 36, wherein the guide includes an upwardly pivotal covering at a rear end thereof.

38. The vehicle according to claim 31, and further including a transverse beam for supporting, guiding and locking the movable collecting container disposed in a rear end region of the vehicle chassis, the transverse beam being mounted so as to be pivotal about a pivot axis extending in a direction parallel to the longitudinal axis of the vehicle, the pivot axis being flush with an articulation axis of the third fastening point of the support.

39. The vehicle according to claim 38, and further including at least one positioning spring element acting between the transverse beam and the vehicle chassis.

40. The vehicle according to claim 14, wherein the pivoting drive means includes:

at least one pivot bearing toothed wheel disposed at the pivot bearing;

a guide arm toothed wheel disposed at a pivot point of at least one of the pair of guide arms; and a form-locking endless traction chain for connecting the pivot bearing toothed wheel to the guide arm toothed wheel.

* * * * *